US012092106B2

(12) United States Patent
Kelsall

(10) Patent No.: US 12,092,106 B2
(45) Date of Patent: Sep. 17, 2024

(54) VALVE ARRANGEMENT

(71) Applicant: Richard Paul Kelsall, Tetbury (GB)

(72) Inventor: Richard Paul Kelsall, Tetbury (GB)

( * ) Notice: Subject to any disclaimer, the term of this patent is extended or adjusted under 35 U.S.C. 154(b) by 70 days.

(21) Appl. No.: 17/879,513

(22) Filed: Aug. 2, 2022

(65) Prior Publication Data

US 2023/0034235 A1 Feb. 2, 2023

(30) Foreign Application Priority Data

Aug. 2, 2021 (GB) ..... 2111121

(51) Int. Cl.
*F04C 19/00* (2006.01)

(52) U.S. Cl.
CPC ..... *F04C 19/007* (2013.01); *F04C 19/004* (2013.01)

(58) Field of Classification Search
CPC .... F04C 19/007; F04C 19/004; F04C 19/005; F04C 7/00; F04C 19/00
See application file for complete search history.

(56) References Cited

U.S. PATENT DOCUMENTS

| | | | |
|---|---|---|---|
| 3,484,038 | A | 12/1969 | Martin |
| 4,850,808 | A | 7/1989 | Schultze et al. |
| 5,015,161 | A | 5/1991 | Amin et al. |
| 2002/0085922 | A1 | 7/2002 | Cavatorta |
| 2010/0158740 | A1 | 6/2010 | Stegmair et al. |
| 2012/0324886 | A1 | 12/2012 | Assaf |
| 2014/0377113 | A1* | 12/2014 | Flenche ..... F01C 1/07 418/241 |
| 2020/0173439 | A1 | 6/2020 | Ueda et al. |

FOREIGN PATENT DOCUMENTS

| | | |
|---|---|---|
| CN | 201730826 | 2/2011 |
| CN | 103122860 | 6/2015 |
| DE | 19913633 | 10/2000 |
| EP | 0069531 | 1/1983 |
| EP | 0554937 | 8/1993 |
| GB | 703534 | 2/1954 |
| GB | 710611 | 6/1954 |
| GB | 1142670 | 2/1969 |
| GB | 1185754 | 3/1970 |

(Continued)

OTHER PUBLICATIONS

English Translation of JPH08177771, generated from Espacenet on May 10, 2024. (Year: 1996).*

(Continued)

*Primary Examiner* — Bryan M Lettman
(74) *Attorney, Agent, or Firm* — Alley IP

(57) ABSTRACT

Liquid ring systems are known for compressing gasses. However, known systems include moving surfaces that require high precision manufacturing. A valve arrangement for a liquid ring system comprising: a plurality of plates; a vane set; and a chamber set that comprises at least one chamber, wherein a first chamber of the chamber set comprises: a first valve, disposed on a first plate of the plurality of plates, which is configured to be closer to the first face of a first vane of the vane set than the second face of the second vane of the vane set; and a second valve, disposed on a second plate, which is configured to be closer to the second face of the second vane than the first face of the first vane.

16 Claims, 11 Drawing Sheets

(56) References Cited

FOREIGN PATENT DOCUMENTS

| | | | | |
|---|---|---|---|---|
| IN | 108087277 | | 5/2018 | |
| JP | H08177771 | * | 7/1996 | ..... F01C 21/08 |
| JP | H 09209976 | | 8/1997 | |
| RU | 2414625 | | 3/2011 | |
| WO | 92/10681 | | 6/1992 | |
| WO | 2008054254 | | 5/2008 | |
| WO | 2018/004778 | | 1/2018 | |

OTHER PUBLICATIONS

UK IPO, Search Report in corresponding UK Application GB2111121.
6, Sep. 30, 2021.

* cited by examiner

VALVE ARRANGEMENT

RELATED APPLICATIONS

This application claims priority to GB Application 2111121.6, filed Aug. 2, 2021, under 35 U.S.C. § 119. This GB application is incorporated by reference herein in its entirety.

FIELD

The present invention relates generally to a valve arrangement for use in a liquid ring system and a method for pumping and/or changing the pressure of a working fluid using said arrangement. The valve arrangement finds particular, although not exclusive, utility in pumping or compressing air for heat pump arrangements

BACKGROUND

Liquid ring systems, such as liquid ring pumps, liquid ring compressors, liquid ring decompressors and/or liquid ring expanders are known.

Existing liquid ring systems necessitate time consuming high precision manufacturing techniques, which are costly and prohibit access to the energy efficient technology from price conscious markets, such as the domestic heat pump or heat exchanger markets.

Multistage liquid ring systems may be used to compound the efficacy of a system by using a series of multiple containers each retaining an amount of sealing fluid therein. Multiple high precision interfaces between the respective containers and vaned impellers decreases the system durability as the system will fail when a single high precision interface fails.

A liquid ring compressor includes a vaned impeller moving about an axis offset from the center of a container. Inlet and outlet valves are provided in a fixed position on the container, such that gas enters a chamber through the inlet valve into a chamber formed between the container and the vanes of the vaned impeller. The vaned impeller rotates with respect to the container. High precision machining is required to ensure the moving edges of the vaned impeller are sealed against the ends of the container without preventing movement between the container and the vanes. The gas is moved about the axis offset from the center of the container by the rotation of the vaned impeller to an outlet valve. As the vaned impeller rotates, the volume of the chamber between the vanes of the vaned impeller changes based on an amount of sealing liquid that fills the space between the vanes. The nature of the change between the inlet and the outlet varies depending on the type of liquid ring system. For example, the volume of the chamber in a compressor decreases between the inlet and the outlet, thereby compressing the gas in the chamber.

SUMMARY

According to a first aspect there is provided a valve arrangement for a liquid ring system comprising: a plurality of plates arranged to face each other, comprising a first plate and a second plate spaced apart by a first distance, and each plate of the plurality of plates comprising at least one valve, wherein each of the plurality of plates is configured to be rotatable about a first axis at a first speed; a vane set disposed between the first plate and the second plate, each vane of the vane set having a first face and a second face; a chamber set comprising at least one chamber, wherein a first chamber of the chamber set is bounded by the first plate, the second plate, the first face of a first vane of the vane set, and the second face of a second vane of the vane set, wherein each vane of the vane set is impermeable to a working fluid and each vane extends between the first plate and the second plate to prevent fluid from bypassing the vane between the vane and the first plate and the vane second plate; and wherein the first chamber of the chamber set comprises: a first valve, disposed on the first plate, wherein at least a portion of the first valve is configured to be closer to the first face of a first vane of the vane set than the second face of the second vane of the vane set; and a second valve, disposed on a second plate, wherein at least a portion of the second valve is configured to be closer to the second face of the second vane than the first face of the first vane.

In this way, a structure may be provided in which the chambers are sealed at each end without relying on a leakproof seal between moving surfaces, such as the container and the vane set. As this leakproof seal is no longer required between moving surfaces, the manufacturing tolerances can be relaxed without compromising on the effectiveness of the device. Relaxed manufacturing tolerances significantly reduce manufacturing costs and assist in making liquid ring systems available to the domestic market. Furthermore, removal of high precision moving parts increases durability and service life of the system.

Each plate of the plurality of plates may be thin relative to its length and/or width. For example, the length and/or width of the plate may be at least 10, 100, or 1000 times larger than the thickness of the plate. Each plate may be a separate sheet of material. The sheet of material may be substantially flat across at least 50%, 65%, 80%, or 95% of its surface. Perturbations, such as protrusions or indentations, in the surface of each plate may not exceed 10, 100 or 1000 times the thickness of the plate. Each plate may be impermeable to a working fluid. Each plate of material may be formed from a heat-resistant plastic, a metal, a ceramic and/or a composite material. By way of example only, the plates may be formed of wood because of the reduced need for tight manufacturing tolerances. The wood may be treated with a treatment, such as varnish, to prevent the working fluid from penetrating or otherwise damaging the wood. Each plate may be non-porous or otherwise configured to prevent a working fluid from passing through the plate. Each plate may comprise openings and/or valves to enable the passage of a working fluid past the plate through the openings and/or valves.

Each plate of the plurality of plates may be the same shape. For example, the largest surface of each plate may form a geometric shape, such as a rhombus, a circle, an ellipse, a square, a rectangle, and/or a triangular. In some examples, each plate may be a disc.

The plurality of plates may all be rotated at the same speed and/or synchronously. The plurality of plates may be configured to rotate at the same speed and/or synchronously to ensure that the respective valves of the plates maintain a fixed position with respect to each other. An orientation of the first plate may be fixed with respect to a second plate. It may be understood that any valve of a given plate of the plurality of plates may be both an inlet to one chamber and an outlet into another chamber. For example, an inlet valve may allow working fluid into one chamber but out of a preceding area and/or chamber. Each valve may be a hole cut away from or out of the plate, or respective plate. Each plate of the plurality of plates may be connected by a rod to each other plate in the plurality of plates. The rod that connects each plate of the plurality of plates may have any cross sectional shape. For example, the rod may be an axle, a tube, a shaft, or a cylinder. The rod connecting each plate of the plurality of plates may be hollow. The rod connecting each plate of the plurality of plates may be connected to the center of each plate and/or the edge of each plate. In other examples, the plates may be rotated by non-physical connections, such as magnets.

The vane set may be arranged to provide an impeller, or more specifically a vaned impeller. Each vane of the vane set may be directed toward a common point on the first and/or second plate. For example, each vane of the vane set may be arranged radially. Each vane of the vane set may be directed toward a central point on a surface of the first and/or second plate, otherwise known as radially. Vanes of the vane set may branch out from or be directed towards a common point and/or common center of a surface of the first and/or second plate.

Each vane of the vane set may be formed from a sheet of material. Each vane of the vane set may be thin relative to its length and/or width. For example, the length and/or width of the vane may be at least 10, 100, or 1000 times larger than the thickness of the vane. Each vane of the vane set may have a profile along the surface of at least one plate that is straight, or curved. Each vane of the vane set may have a twisted or curved profile. Alternatively or additionally the profile of each vane may be twisted such that a profile of an edge of the vane in contact with the first plate is different to a profile of an edge of the vane in contact with second plate. Each vane may comprise a non-porous surface, non-porous faces, or no porous faces. Each vane may be formed from a heat-resistant plastic, a metal, ceramic and/or a composite material.

A vane face, or face of a vane, is surface of the vane which is exposed to the chamber. Each vane of the vane set may have two faces. The two vane faces may be the two largest surfaces of a vane. For example, each vane of the vane set may have a forward face and a rearward face. The forward face may face the direction of rotation or face a direction closer to the direction of rotation than against the direction of rotation. The rearward face may face against the direction of rotation or may face a direction that is closer to against the direction of rotation than the direction of rotation.

The chamber set comprises at least one chamber. There may be the same number of chambers as there are vanes in the vane set. For example, the total number of chambers and vanes between the first and second plates may be 1, 2, 3, 4, 5, 6, 7, 8, 9, or 10.

A first chamber of the chamber set may be bounded by the first plate, the second plate, the first face of a first vane of the vane set, and the second face of a second vane of the vane set. In some examples, only one chamber is present and, in these examples, the first vane and second vane may be the same vane.

A second chamber of the chamber set may be bounded by the first plate, the second plate, the first face of a second vane of the vane set, and the second face of a third vane of the vane set, wherein the third vane and the first vane may be the same vane, e.g., if only two chambers are present. The second chamber may be adjacent to the first chamber. More specifically, two chambers formed using a common or shared vane may be described as adjacent or directly adjacent chambers.

It may be understood, more generally, that in some examples the first vane and the last vane (e.g. the highest numbered vane) in the vane set described herein refers to the same vane. Each chamber of the chamber set may be bounded by the first plate and the second plate. Each chamber of the chamber set may be bounded by the first plate, the second plate, and two vane faces of the vane set.

Each chamber of the chamber set may be configured to include a valve disposed on the first plate and a valve disposed on the second plate. Alternatively or additionally, each chamber of the chamber set may be configured to include at least two valves disposed on the first plate and/or second plate.

Each vane of the vane set extends between the first plate and the second plate to prevent fluid from bypassing the vane between the vane and the first plate and the vane and the second plate. For example, the vane may be connected directly and/or indirectly along its entire length to the first and/or second plate with a fluid tight connection. A fluid tight connection prevents fluids from passing therethrough. Examples of fluid tight connections include, but are not limited to, a interference fit, welding or a continuous line of adhesive.

The first valve comprises a geometric center, and the geometric center of the first valve may be configured in the valve arrangement to be closer to the first face of a first vane of the vane set than the second face of the second vane of the vane set. The second valve comprises a geometric center, and the geometric center of the second valve may be configured in the valve arrangement to be closer to the second face of the second vane than the first face of the first vane.

In some examples, the plurality of plates comprise a third plate, wherein the third plate faces an opposite side of the second plate to the first plate. The third plate may be spaced apart from the second plate by a second distance. A third valve may be disposed on the third plate and a second vane set disposed between the second plate and third plate. Each vane of the second vane set having a first face and a second face. The first, second and third valves are rotationally spaced about the first axis such that the second valve does not overlap the first valve or the third valve. The first axis may originate at the center of the plurality of plates extend in a direction perpendicular to the plates. The first axis may originate at the center of a plate of the plurality of plates and extend in a direction perpendicular to the plate.

In this way, multiple liquid ring stages can be implemented to enhance the effectiveness of the system to, for example, enhance the compression or decompression factor of the system. It may be understood that implementing multiple stages in this way further reduces friction, for example, between a tubular vessel around the valve arrangement and the valve arrangement, and thereby increases the efficiency of the system. Moreover, the system size for multiple stages is reduced and accordingly a powerful system with multiple stages may be implemented in smaller spaces, such as residential properties, rather than being limited to large warehouses.

Valves that do not overlap, otherwise referred to as non-overlapping valves, as discussed herein are valves for which the openings are arranged to be spaced apart by a first distance in a first direction and offset by a second distance in a second direction, wherein the second distance is sufficiently large to ensure that the edges of the valves would not intersect regardless of the spacing in the first direction. Non-overlapping valves may also be arranged to enter a predetermined maximum inner diameter of a hollow tube of sealing fluid during the rotation of the valve arrangement or plurality of plates at different rotational angles or rotational positions of said valve arrangement or plurality of plates.

The third plate may be located closer to the second plate than it is to the first plate. The first plate and second plate may form a first pair of plates. The second plate and third plate may form a second pair of plates. Each pair of plates comprises a respective vane set. Each vane of the second vane set may be directed toward a second common point on the second and/or third plate. It may be understood that any property described with respect to the first pair of plates and their respective vane set may also be a property of the second pair of plates and their respective vane set.

A fourth plate may be provided in addition to the third plate. The fourth plate and the third plate may form a third pair of plates with a respective vane set disposed there between. It may be understood that any property described with respect to the second pair of plates and their respective vane set may also be a property of the third pair of plates and their respective vane set. Each successive pair of plates with a respective vane set may be another instance of the first pair of plates with its respective vane set, and each successive pair of plates may include a plate from the preceding pair of plates. For ease of reference, a pair of plates and its respective vane set may be referred to as a stage. Each stage may do work on the working fluid output from the preceding stage to increase the effectiveness of the system.

The first, second and third valves may be rotationally spaced about the first axis such that the second valve does not overlap the first valve or the third valve such that at least one of the first, second and third valves are always submerged beyond a predetermined maximum inner diameter of a hollow tube of sealing fluid during the rotation of the plurality of plates.

In this way, backflow through the system is prevented as one valve of each chamber is always covered or submerged in sealing fluid. The valves being rotationally spaced means that each valve is not disposed on the same radial line of the plate and/or plurality of plates. The hollow tube of sealing fluid may be, or be shaped like, a hollow cylinder, a hollow polyhedron, a hollow triangular prism, a hollow cuboid, a hollow hexagonal prism or a hollow octagonal prism. A tube refers to a shape that encloses a volume at least along its length and has a first end at one end of the length and a second end at a second end of the length. A tube may be long relative to its width. The diameter of the tube may refer to a diameter of the width, or a diameter of the end of the tube or an end profile of the tube.

In some examples, the second distance between the second and third plates is greater than or smaller than, but not equal to, the first distance between the first and second plates.

This may enable the valve arrangement to increase the maximum pressure change applied to a working fluid passed through the system for a given size of tubular vessel. In some examples, the plates may get progressively closer together towards a working fluid outlet in a liquid ring system, such as a compressor. In this way, progressively smaller chambers may be formed between the respective plates and vanes without wasting any compressible volume within the tubular vessel. A working fluid that is being compressed may be moved into each progressively smaller volume as it moves towards the working fluid outlet. In some examples, the plates may get progressively further apart towards a working fluid outlet in a liquid ring system, such as an expander. In this way, progressively larger chambers may be formed between the respective plates and vanes without wasting any expandable volume within the tubular vessel. A working fluid that is being expanded may be moved into each progressively larger volume as it moves towards the working fluid outlet.

The first pair of plates may be spaced apart by the same or equal distance as the second pair of plates are spaced apart and/or each successive pair of plates are spaced apart. The same or equal spacing provides consistent performance in each stage. Alternatively, the first pair of plates may be spaced apart by a greater distance than the second pair of plates are spaced apart. This enables a higher maximum pressure to be realized by the system. Alternatively, the first pair of plates may be spaced apart by a smaller distance than the second pair of plates are spaced apart, which enables a larger decompression to be realized by the system.

The distance, otherwise known as separation, between each successive pair of plates may increase. The distance between each successive pair of plates may decrease.

In some examples, the plurality of plates may include a number of plates and the chamber set includes a number of chambers, the number of plates being at least one more than the number of chambers.

In this way a backflow prevention mechanism may be provided as the chambers may be configured such that the first chamber of the first stage fills with working fluid as the second chamber the of the second stage, sequential to the first chamber, does work on the fluid. Accordingly, there is no direct working fluid communication through multiple stages of the valve arrangement at once, thus preventing any backflow of working fluid through the system. This is particularly advantageous for cost reduction, as backflow can be prevented by the arrangement of valves without the inclusion of special valves such as backflow valves or pressure valves. Using this valve arrangement, backflow can be prevented even if each valve is a hole in the plate. Backflow is not desirable as it may reduce the efficiency of the system.

In some examples, the first chamber is further configured to be bounded, in use, by a sealing fluid at a perimeter of the first plate and a perimeter of the second plate, and/or the at least one valve is arranged on each plate of the plurality of plates such that, in use, it is submerged through a predetermined maximum inner diameter of a hollow tube of sealing fluid during the rotation of the plurality of plates, said arrangement being based on said predetermined maximum inner diameter and a predetermined offset between a center of said predetermined maximum inner diameter and the first axis.

In this way, the chamber may be fully enclosed in use to maximize the change in pressure within the chamber. That is, the full chamber may be fully enclosed by a combination of the first plate, the second plate the first face of a first vane, the second face of a second vane and a sealing fluid. In alternative examples, the sealing fluid may seal the chamber further inside the first and second plates, rather than the perimeter, and thereby reducing the maximum chamber size that can be filled with working fluid. The first chamber may be bounded, in use, by a sealing fluid at a part of, or all of, the perimeter of the first plate and at a part of, or all of, the perimeter of the second plate. The predetermined offset between a center of said predetermined maximum inner diameter and the first axis may be an offset perpendicular to the axis. The predetermined maximum inner diameter may have an axis perpendicular to the diameter, wherein the axis perpendicular to the diameter is the same as or parallel to the axis about which the tubular vessel rotates.

Determining that a valve is submerged through a predetermined maximum inner diameter of a hollow tube of sealing fluid during the rotation of the plurality of plates or the valve arrangement may be based at least in part on said predetermined maximum inner diameter and a predetermined offset between a center of said predetermined maximum inner diameter and the first axis about which the plurality of plates is configured to be rotatable.

In some examples, the first vane of the vane set, and the second vane of the vane set are the same vane.

In this way, single chamber operation of the system may be provided and thereby less raw material is required to construct the valve arrangement.

In some examples, each valve of the at least one valve comprises an opening in the plate and/or an open-ended tubular member.

In this way a cost effective valve may be provided with minimal manufacturing complexity. Moreover, an open-ended tubular member enables greater flexibility in cycle timings. In some examples, the first end of the open-ended tubular member does not fully and/or partially overlap the second end of the open-ended tubular member of the valve in the first axis about which the plurality of plates is configured to rotate. In some examples, the first end of the open-ended tubular member is offset, by a tubular member offset, from the second end of the open-ended tubular member of the valve in at least a direction perpendicular to the first axis about which the plurality of plates is configured to rotate. The tubular member offset may be measured as a proportion of the largest dimension of the opening of an end of open-ended tubular member. The tubular member offset may be at least 50%, 100%, 150% or 200% of the largest dimension of the opening of an end of open-ended tubular member.

In some examples, each valve of the at least one valve comprises a non-return valve and/or a pressure sensitive valve.

In this way, a more efficient valve arrangement may be provided that prevents backflow and/or that delivers a working fluid at controlled pressure range.

According to a second aspect there is provided a liquid ring system. The liquid ring system comprises the valve arrangement described herein disposed within a tubular vessel. The tubular vessel comprises a working fluid inlet at a first end of the tubular vessel and a working fluid outlet at a second end of the tubular vessel, wherein the tubular vessel is configured to retain a sealing fluid and to be rotated at a second speed that exerts a centrifugal force on the sealing fluid and wherein the axis of rotation of the tubular vessel is a second axis that is offset from the first axis by a first offset. The liquid ring system is configured such that, in use, an edge of each plate of the plurality of plates is submerged in the sealing fluid such that a working fluid is only able to pass within the tubular vessel, between the working fluid inlet and working fluid outlet, through the at least one valve of each plate of the plurality of plates.

In this way, a system may be provided in which the tubular vessel and the valve arrangement both rotate to reduce losses such as viscous losses or losses caused by friction thereby providing a more efficient system. In addition, a structure may be provided in which the chambers are sealed at each end without relying on a leakproof seal between moving surfaces, such as the container and the vane set. As this leakproof seal is no longer required between moving surfaces, the manufacturing tolerances can be relaxed without compromising on the effectiveness of the device. Relaxed manufacturing tolerances significantly reduce manufacturing costs and facilitate making liquid ring systems available to the domestic market. Furthermore, removal of high precision moving parts increases durability and service life of the system.

The valve arrangement may be configured to be disposed within the tubular vessel. The tubular vessel may be a container for fluids and otherwise known as a tubular container. The tubular vessel may comprise an inlet valve on a first face of the vessel and an outlet on a second face of the vessel. The tubular vessel may be enclosed on all sides, except for one or more valves. The tubular vessel may be configured to prevent the escape of a sealing fluid, whilst permitting a working fluid to enter through an inlet at one end of the tubular vessel and escape through an outlet at the other end of the tubular vessel. For example, the inlet and outlet of the tubular vessel may be arranged above a predetermined level of sealing fluid, wherein the predetermined level of sealing fluid may be a level of the sealing fluid when the vessel is stationary or in use. The inlet and outlet of the tubular vessel may be inlet and outlet valves of the tubular vessel.

The valve arrangement may be configured to be disposed within the tubular vessel such that the axis of rotation of the valve arrangement is in the same orientation as the axis of rotation of the tubular vessel. The axis of rotation of the valve arrangement may be parallel to the axis of rotation of the tubular vessel. The valve arrangement may be disposed within the tubular vessel such that a longitudinal axis perpendicular to the plates of the valve arrangement is in the same orientation as the longitudinal axis of the tubular vessel. The tubular vessel may be an elongated three dimensional shape. The tubular vessel may be, or be shaped like, a cylinder, a polyhedron, a triangular prism, a cuboid, a hexagonal prism or an octagonal prism. The tubular vessel may be, or be shaped like, a hollow cylinder, a hollow polyhedron, a hollow triangular prism, a hollow cuboid, a hollow hexagonal prism or a hollow octagonal prism. A vessel may be a container configured to retain a working fluid and/or a sealing fluid. For example, a vessel may be impermeable to a working fluid and/or a sealing fluid. The vessel may be an enclosure comprising one or more valves. The sealing fluid in use may be in the shape of, or be shaped like, a hollow cylinder, a hollow polyhedron, a hollow triangular prism, a hollow cuboid, a hollow hexagonal prism or a hollow octagonal prism. The tubular vessel may be closed at each end. For example, the tubular vessel may be closed at each end to retain a working fluid.

The working fluid may be the fluid which is to be worked on by the liquid ring system. The liquid ring system may be configured to work on the working fluid. Working on the working fluid may include at least one of changing the pressure of the fluid or facilitating the movement of the fluid in a particular direction. Fluid refers to a liquid or gas.

The sealing fluid may be the fluid which is prevents the escape of, or otherwise retains, the working fluid. The liquid ring system may be configured to impart kinetic energy to the sealing fluid to facilitate the retention of the working fluid. A tubular vessel configured to retain the sealing fluid may be configured to rotate to impart a centrifugal force to the sealing fluid. The vane set may be configured to impart a rotational force to the working fluid and/or the sealing fluid. The sealing fluid may be configured to prevent the working fluid from bypassing a plate of the plurality of plates, each plate of the plurality of plates, multiple plates of the plurality of plates, or all plates of the plurality of plates. The sealing fluid may be configured to fill any gaps between the tubular vessel and a plate of the plurality of plates, each plate of the plurality of plates, multiple plates of the plurality of plates, or all plates of the plurality of plates to provide a physical barrier to the working fluid. The physical barrier may prevent the working fluid from bypassing the edge of one or more plates of the plurality of plates. Fluid refers to a liquid or gas. In an example, the working fluid may be a gas and the sealing fluid may be a liquid. Alternatively, both the working fluid and the sealing fluid may be liquids. Alternatively, both the working fluid and the sealing fluid may be gases.

The working fluid inlet of the tubular vessel may be at a first end of the tubular vessel and a working fluid outlet of the tubular vessel at a second end of the tubular vessel, wherein the first and second ends of the vessel may be the same or different ends of the tubular vessel.

The tubular vessel may be configured to retain a sealing fluid and to be rotated at a second speed that exerts a centrifugal force on the sealing fluid. The axis of rotation of the tubular vessel may be a second axis that is offset from the first axis by a first offset. The first offset may be an offset perpendicular to the first and/or second axis. The first offset may be at least 10%, 20% or 30% of the diameter of the tubular vessel. The diameter of the tubular vessel may be measured as the diameter of the shape of the face of the vessel that is perpendicular to the longitudinal axis of the tubular vessel. Alternatively or additionally, the first offset may be at least 15%, 30% or 45% of the diameter of a plate of the plurality of plates. For example, the first offset may be at least 15%, 30% or 45% of the diameter of the largest and/or smallest plate of the plurality of plates.

The liquid ring system may be configured such that, in use, an edge of each plate of the plurality of plates is submerged in the sealing fluid such that a working fluid is only able to pass within the tubular vessel, between the working fluid inlet and working fluid outlet, through the at least one valve of each plate of the plurality of plates. That is, in use, the tubular vessel may be configured to rotate at, or be rotated at, a speed high enough to imbue a centrifugal force to the sealing fluid and thereby causes the sealing fluid to at least partially line the inside of the tubular vessel with sealing fluid. The at least partial lining may refer to a lining of the tubular vessel with sealing fluid on one or more inner faces of the tubular vessel that are not perpendicular to the axis of rotation of the plates and/or the axis of rotation of the tubular vessel.

The second axis may originate at the center of the tubular vessel and extend along the longitudinal axis of the tubular vessel.

In some examples, the liquid ring system may be a liquid ring pump, a liquid ring compressor, a liquid ring decompressor and/or a liquid ring expander.

In some examples, the working fluid may be less dense than the sealing fluid as measured by at least one known measurement technique.

In this way, the sealing fluid may facilitate the retention of the working fluid at higher pressures. A liquid ring system configured in this way enables operation at higher pressures, and/or a wider range of pressures and thereby offers a more versatile system. For example, higher working fluid compression pressures may be realized and/or working fluids at a higher pressures may be decompressed. The sealing fluid may be more dense than the working fluid, as measured by at least one known measurement technique.

The at least one known measurement technique may be, or include the use of, one or more of: a hydrometer, a hydrostatic balance method, an immersed body method, a pycnometer, or an oscillating densitometer.

The sealing fluid may be selected or configured such that it is more dense than the working fluid. The working fluid may be selected or configured such that it is less dense than the sealing fluid. Selection or configuration in this manner may enhance a pressure seal of the chamber such that the working fluid does not bypass the chambers around the outer perimeter of the plates and/or through valve openings in the plates when they are sealed with sealing fluid.

In some examples, the working fluid is a gas and the sealing fluid is a liquid. Selection or configuration in this manner may further enhance a pressure seal of the chamber such that the working fluid does not bypass the chambers around the outer perimeter of the plates and/or through valve openings in the plates when they are sealed with sealing fluid. Thereby, increased system versatility and higher pressure system operation may be achieved.

In some examples, the first speed is the same as the second speed, wherein the first speed is the speed of rotation of the plurality of plates and the second speed is the speed of rotation of the tubular vessel. Alternatively or additionally, the first speed is the same as the second speed, and the first speed and second speed act in the same rotational direction.

In this way, components configured to rotate the plates of the plurality of plates and the tubular vessel can work synergistically to increase the efficiency of the system. Components configured to rotate the plates of the plurality of plates and the tubular vessel may be, for example, one or more motors. By rotating plates of the plurality of plates and the tubular vessel at the same speed in the same direction, the system efficiency may be further increased because losses can be further reduced as the viscous losses in the sealing fluid may be reduced and the plates may experience less friction from passing through the sealing fluid. This effect may be further enhanced by synchronizing the rotation of the plurality of plates with the rotation of the tubular vessel.

In some examples, the liquid ring system comprises, in use, a hollow tube of sealing fluid having a predetermined maximum inner diameter, formed by the rotation of the tubular vessel containing said sealing fluid. At least one of the first valve and second valve being arranged to be submerged in the hollow tube of sealing fluid at any stage of rotation of the valve arrangement, based on said predetermined maximum inner diameter of the sealing fluid and the first offset, to prevent a reverse flow of working fluid through the vessel.

In this way, the chamber may be fully enclosed in use to maximize the change in pressure within the chamber by enclosing the first and second valves or arranging them to be enclosed. The chamber may be fully enclosed by a combination of the first plate, the second plate the first face of a first vane, the second face of a second vane and a sealing fluid such that at least one valve associated with the chamber is covered by the sealing fluid at any stage of the rotation of the plate based on said predetermined maximum inner diameter of the sealing fluid and the first offset. In alternative examples, the sealing fluid may seal the chamber further inside the first and second plates, rather than the perimeter, and thereby reducing the maximum chamber size that can be filled with working fluid.

The predetermined maximum inner diameter of the sealing fluid is based at least in part on one or more of: the first speed of rotation of the plurality of plates, the second speed of the rotation of the tubular vessel, the offset between the rotational axis of the plurality of plates and the rotational axis of the tubular vessel, the shape of the tubular vessel, the diameter of the tubular vessel, the aspect ratio of the tubular vessel, volume enclosed by the tubular vessel, the volume of sealing liquid. The maximum inner diameter of the sealing fluid may define a surface of the sealing fluid, in use, that will always touch the surface of, or be submerged in the sealing fluid. The maximum inner diameter of the sealing fluid may be defined by a circle with a radius that has the smallest length from the rotational axis of the tubular vessel that will touch the inner surface of, or be submerged in, the sealing fluid at every stage in the rotation of said smallest length about the rotational axis of the tubular vessel.

According to a third aspect there is provided a method for operating a liquid ring system. The method comprises rotating the tubular vessel of the liquid ring system described herein about the second axis at a second speed and applying working fluid, from a source of working fluid, at a first pressure to the working fluid inlet. The method also comprises rotating the valve arrangement about the first axis at the first speed to cause a change in pressure within the first chamber by: submerging the second valve into the sealing fluid; emerging the first valve from the sealing fluid to expose the first valve to the working fluid, such that the working fluid fills the chamber at the first pressure; enclosing the first chamber within the bounds of the first plate, the second plate, the first face of a first vane of the vane set, and the second face of a second vane of the vane set, by preventing reverse flow of working fluid through the first valve using at least one of a backflow prevention valve, a preceding sealed chamber of the valve arrangement in pressure communication with the first chamber or by submerging the first valve in the sealing fluid; adjusting a penetration depth of the first chamber into the sealing fluid, based at least in part on the offset of the second axis from the first axis, to adjust a volume of the first chamber; and emerging the second valve from the sealing fluid.

In this way, a system in which the chambers are sealed at each end may be operated without relying on a leakproof seal between moving surfaces, such as the container and the vane set. As this leakproof seal is no longer required between moving surfaces, the manufacturing tolerances can be relaxed without compromising on the effectiveness of the device. Relaxed manufacturing tolerances significantly reduce manufacturing costs and facilitate the making liquid ring systems available to the domestic market. Furthermore, removal of high precision moving parts increases durability and service life of the system.

Enclosing the chamber is to provide a volume for retaining working fluid at both its original and modified pressure. In use, a surface of the sealing fluid may form at least one surface of the enclosure. The working fluid may be retained by preventing reverse flow of working fluid through the first valve using a preceding sealed chamber of the valve arrangement in pressure communication with the first chamber, where the preceding sealed chamber may be another chamber of the valve arrangement that is in pressure, fluid and/or working fluid communication with the first chamber. The preceding sealed chamber may be any chamber of the valve arrangement in pressure communication with the first chamber, for example through the first valve, such that pressure between the chambers can equalize. The preceding sealed chamber may have a preceding valve sealed by at least one of a backflow prevention valve, another preceding sealed chamber of the valve arrangement in pressure communication with the preceding chamber or by submerging the preceding valve in the sealing fluid.

In this way, the first chamber and one or more preceding chambers may be sub-chambers configured to work together as one effective chamber. The sub-chambers are in pressure communication and, therefore, pressure between the sub-chambers equalizes such that the effective chamber contains working fluid at a relatively consistent pressure. The relatively consistent pressure between the sub-chambers prevents backflow therebetween and promotes forward flow during the change in volume of the effective chamber. The effective chamber may be operated in accordance with the operation of the chambers as described herein. In addition, the effective chamber may encompass different sub-chambers depending on the rotational stage of the valve arrangement. The effective chamber containing multiple sub-chambers may enable the pressure of a larger volume of working fluid to be compressed, pumped or decompressed during a single rotation of the valve arrangement than a single sub-chamber.

According to a fourth aspect there is provided a method for operating a valve arrangement in a liquid ring system, comprising rotating the valve arrangement described herein about the first axis at the first speed to cause a change in pressure within the first chamber. The change in pressure within the first chamber being caused by: submerging the second valve through a predetermined maximum inner diameter of a hollow tube of sealing fluid; emerging the first valve from the predetermined maximum inner diameter of the hollow tube of sealing fluid; enclosing the first chamber within the bounds of the first plate, the second plate, the first face of a first vane of the vane set, and the second face of a second vane of the vane set, by preventing, in use, a reverse flow of working fluid through the first valve using at least one of a backflow prevention valve, a preceding sealed chamber of the valve arrangement in pressure communication with the first chamber or by submerging the first valve through the predetermined maximum inner diameter of the hollow tube of sealing fluid; adjusting a penetration depth of the first chamber into the predetermined maximum inner diameter of the hollow tube of sealing fluid, based at least in part on a predetermined offset between a center of said predetermined maximum inner diameter and the first axis; and emerging the second valve from the predetermined maximum inner diameter of the hollow tube of sealing fluid.

In this way, a valve arrangement as described herein may be operated within in a liquid ring system in which the chambers are sealed at each end without relying on a leakproof seal between moving surfaces, such as the container and the vane set. As this leakproof seal is no longer required between moving surfaces, the manufacturing tolerances can be relaxed without compromising on the effectiveness of the device. Relaxed manufacturing tolerances significantly reduce manufacturing costs and facilitate the making liquid ring systems available to the domestic market. Furthermore, removal of high precision moving parts increases durability and service life of the system.

The working fluid may be retained by preventing reverse flow of working fluid through the first valve using a preceding sealed chamber of the valve arrangement in pressure communication with the first chamber, where the preceding sealed chamber may be another chamber of the valve arrangement that is in pressure, fluid and/or working fluid communication with the first chamber. The preceding sealed chamber may have a preceding valve sealed by at least one of a backflow prevention valve, another preceding sealed chamber of the valve arrangement in pressure communication with the preceding chamber or by submerging the first valve through the predetermined maximum inner diameter of the hollow tube of sealing fluid. In this way, the first chamber and one or more preceding chambers may be sub-chambers configured to work together as one effective chamber, as described herein.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION

Figure 1:
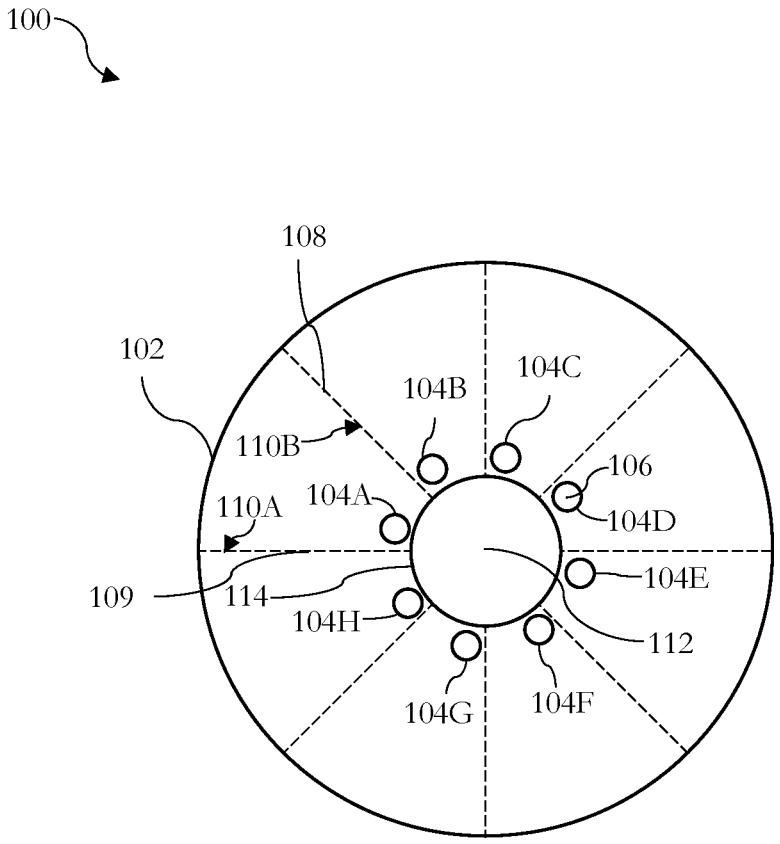
FIG. 1 shows a schematic representation of a plate of the valve arrangement with an associated vane set.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein. Likewise, method steps described or claimed in a particular sequence may be understood to operate in a different sequence.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Thus, the scope of the expression "a device A connected to a device B" should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other. For instance, wireless connectivity is contemplated.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any one embodiment or aspect of the invention may be combined in any suitable manner with any other particular feature, structure or characteristic of another embodiment or aspect of the invention, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances. The use of the term "any" may mean "all" and/or "each" in certain circumstances.

The use of the term "expand" may mean "decompress" or "increase in volume" in certain circumstances. Similarly, the use of the term "expandable" may mean "decompressible" or "increasable in volume" in certain circumstances.

The term "impeller" is defined herein as a rotating part designed to move fluid by rotation.

The principles of the invention will now be described by a detailed description of at least one drawing relating to exemplary features. It is clear that other arrangements can be configured according to the knowledge of persons skilled in the art without departing from the underlying concept or technical teaching, the invention being limited only by the terms of the appended claims.

FIG. 1 shows a schematic representation of a plate 102 of the valve arrangement 100 with an associated vane set. The schematic representation shows an end view including the face of the plate 102. The vane set is shown with vanes 108, 109. This schematic representation shows a series of set of eight vanes extending radially towards a common point. The common point may be the center of the plate 112, as shown in FIG. 1. However, the vanes of the vane set may extend toward a common point anywhere on the face of the plate 102, and/or may extend towards a common and/or central shape. For example, the vanes, 108 109 may extend towards a common shape that is not in the center, or towards a common shape in the center without being directed toward the center of the plate 112. In some examples, as shown in FIG. 1, the vanes extend towards a common central point at center of the plate 112, but also extend toward a common central shape 114. The common or central shape may be any known geometric shape such as a circle, ellipse, square, rectangle, pentagon or hexagon. The common and/or central shape may be defined by a bar or axle to which the plate is attached or configured to be attached. Each vane 108, 109 of the vane set has at least two faces. A vane 109 of the vane set has a first face 110A and a second face. A vane 108 of the vane set has a first face and a second face 110B. The vanes 108, 109 may extend away from the plate 102. For example, the vanes 108, 109 may extend away from the plate, perpendicular to the plate 102. The first face of each vane may face in one rotational direction. The second face of each vane may face in a different rotational direction to the first face.

The plate 102 comprises valves 104A-H. The schematic shows the valves by way of example as circular, but the valves could alternatively be any other geometric profile such as a square, rectangle or ellipse. The valves 104A-H permit fluid to pass through an opening 106. This opening 106 may be a hole or cut out. Alternatively, the opening may comprise a flow control valve such as a backflow valve and/or pressure sensitive valve. The plate may be configured to be rotated. The plate 102 may be configured to rotate about an axis perpendicular to the plate center 112.

Figure 2:
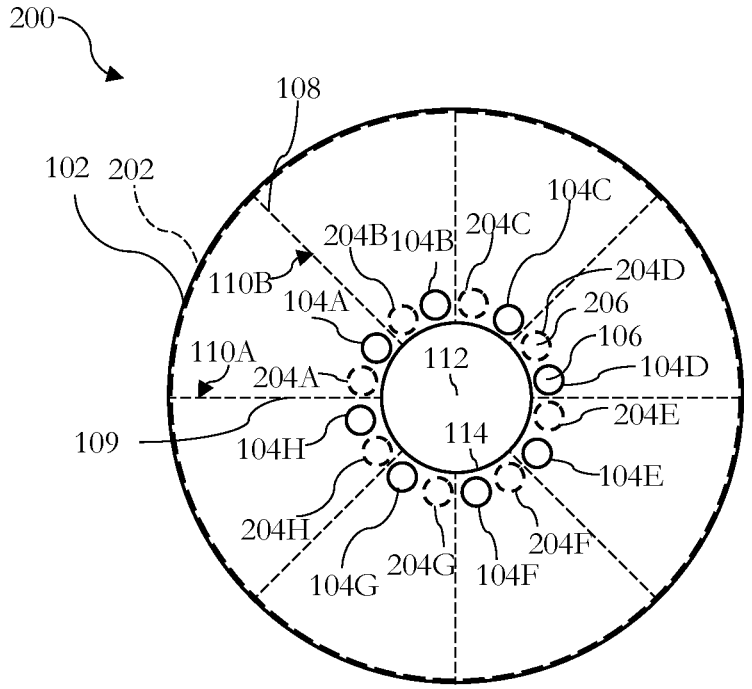
FIG. 2 shows a schematic representation of two plates of the valve arrangement with an associated vane set.

FIG. 2 shows a schematic representation of a first plate 102 and a second plate 202 of the valve arrangement 200 with an associated vane set. The first plate 102 is represented by a solid line. The second plate 202 is represented by a dashed line. The schematic representation shows an end view of the two plates 102, 202, wherein the two plates are facing each other. That is, in some examples and as shown in FIG. 2, the second plate 202 is disposed behind the first plate 102. The first plate 102 and second plate 202 may form a plurality of plates. Features described in relation to FIG. 1 may also apply to the corresponding features shown in FIG. 2.

The vane set is shown with vanes 108, 109. The vanes 108, 109 of the vane set extend from first plate 102 to the second plate 202. The vanes 108, 109 are disposed between the first plate 102 and the second plate 202. This schematic representation shows a series of set of eight vanes extending radially towards a common point. The common point may be the center of the first plate 102 or the second plate 202. The center of each plate of the plurality of plates 102, 202 may be aligned to one another. The vanes of the vane set may extend toward a common point anywhere on the face of the first plate 102 or second plate 202, and/or may extend towards a common or central shape. The common or central shape may be any known geometric shape such as a circle, ellipse, square, rectangle, pentagon or hexagon. The common or central shape may be defined by a bar or axle to which the plate is attached or configured to be attached. Alternatively or additionally, the common or central shape may be defined by a bar or axle to which the plate or vane set is attached or configured to be attached. Each vane 108, 109 of the vane set has at least two faces. A vane 109 of the vane set has a first face 110A and a second face. A vane 108 of the vane set has a first face and a second face 110B. The vanes 108, 109 may extend from the first plate 102 to the second plate 202. For example, the vanes 108, 109 may extend away from the first plate 102 and towards the second plate 202. For example, the vanes 108, 109 may extend between the first plate 102 and second plate 202, perpendicularly to the first plate 102 or the second plate 202.

The first plate 102 comprises valves 104A-H. The second plate comprises valves 204A-H, wherein the valves 204A-H of the second plate 202 are shown with a dashed line. A first chamber may be formed between two adjacent vanes 108, 109, the first plate 102 and the second plate 202. Alternatively or additionally, the first chamber may be formed between the first plate 102, the second plate 202 and two vanes 108, 109 that face each other. Alternatively or additionally, the first chamber may be formed between the first plate 102, the second plate 202 and a first face of a first vane 110A and a second face of a second vane 110B. In some examples, the two vane faces may be different faces of the same vane, for example, if the vane set includes only one vane.

The schematic shows the valves 104A-H, 204A-H by way of example as circular, but the valves 104A-H, 204A-H could alternatively be any other geometric profile such as a square, rectangle or ellipse. The valves 104A-H, 204A-H permit fluid to pass through an opening 106, 206. This opening 106, 206 may be a hole or cut out. Alternatively, the opening 106, 206 may comprise a flow control valve, such as a backflow valve and/or pressure sensitive valve. Each plate may be suitable for rotation or configured to be rotated. That is, the plate may comprise a central fixing for connection to a bar or axle. Alternatively or additionally, each plate may comprise a perimetral member for imparting the force from a rotational member, such as a motor, to the plate. The perimetral member may be a toothed wheel, magnet or wire. Each plate 102, 202 may be configured to rotate about an axis perpendicular to the center of the respective plate.

Figure 3:
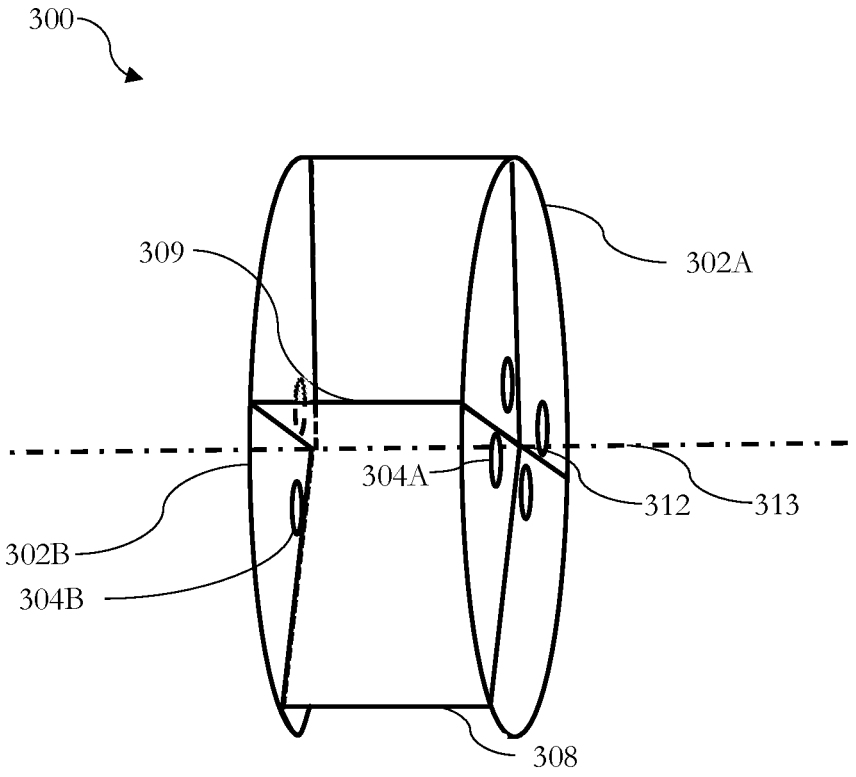
FIG. 3 shows a three-dimensional schematic representation of two plates of the valve arrangement with an associated vane set.

FIG. 3 shows a three-dimensional schematic representation 300 of two plates 302A, 302B of the valve arrangement 300 with an associated vane set 308, 309. Dashed lines show edges that may not be visible if, for example, the vanes are opaque. Some vanes are not shown between the plates to aid intelligibility.

The first plate 302A may be joined to the second plate 302B. For example, the first plate 302A may be joined to the second plate 302B by at least one vane of the vane set 308, 309. The first plate 302A and the second plate 302B are opposite one another and facing each other. The first plate 302A may be parallel to the second plate 302B. The first plate 302A and the second plate 302B may form a plurality of plates. Features described in relation to FIGS. 1 and/or 2 may also apply to the corresponding features shown in FIG. 3.

The vane set is shown with vanes 308, 309. The vanes 308, 309 of the vane set extend from first plate 302A to the second plate 302B. A common point of each plate of the plurality of plates is aligned to one another. In some examples, as shown in FIG. 3, the common point is the center 312 of each plate. The common point of each plate may be aligned to an axis 313. The plurality of plates 302A, 302B may be configured to rotate about the axis 313.

The vanes of the vane set may extend toward a common point anywhere on the face of the first plate 302A or second plate 302B, and/or may extend towards a common or central shape. In some examples, as shown in FIG. 3, the vanes extend toward an axis 313 about which the plurality of plates 302A, 302B is configured to rotate.

The first plate 302A comprises valves 304A. The second plate comprises valves 304B. A first chamber may be formed between two adjacent vanes 308, 309, the first plate 302A and the second plate 302B. It may be understood that corresponding chambers can be formed by additional vanes, in the example shown in FIG. 3 there are four chambers. Each chamber may be formed between two adjacent vanes 308, 309 of the vane set, the first plate 302A and the second plate 302B.

Each chamber may be hollow. Each chamber may partially contain a volume in the shape of a cylindrical sector, as shown in FIG. 3, or any other three-dimensional geometric shape such as a cuboid or cone. It may be understood that the volume of a cylindrical sector may be defined by an inner radius, an outer radius, a height, and angle. The volume partially contained by each chamber may be contained, except for valves, on all but one side and/or all but one surface of the volume. In this way, the chamber may be configured to be sealed by a sealing fluid.

The valve arrangement 300 may be rotated at a first speed about the axis 313. The axis 313 may extend from the face of the first plate, and/or may extend perpendicularly to a face of the first plate 302A and/or the second plate 302B. The valve arrangement may be configured to allow the second valve 304B to be submerged in a sealing fluid when rotated. The sealing fluid is not part of the valve arrangement 300, as such, and the valve arrangement 300 may be preconfigured based on a predetermined maximum inner diameter of a hollow tube of sealing fluid. The configuration based on a predetermined maximum inner diameter of a hollow tube of sealing fluid also allows the valve arrangement 300 to be configured to, when rotated in use, allow the first valve 304A to emerge from the predetermined maximum inner diameter of the hollow tube of sealing fluid and submerge the first valve 304A through the predetermined maximum inner diameter of the hollow tube of sealing fluid to fully enclose the first chamber within the bounds of the first plate, the second plate, the first face of a first vane of the vane set, the second face of a second vane of the vane set, and a sealing fluid (e.g. a hollow tube of sealing fluid). When fully enclosed, a penetration depth of the first chamber into the predetermined maximum inner diameter of the hollow tube of sealing fluid can be adjusted as part of the rotation of the valve arrangement 300 about the axis 313, based at least in part on a predetermined offset between a center of said predetermined maximum inner diameter and the axis 313. The position of axis 313 may be predetermined in relation to the predetermined maximum inner diameter of the hollow tube. The axis 313 may be parallel to the center of said predetermined maximum inner diameter of the hollow tube and the axis 313, wherein the center of the said predetermined maximum inner diameter may refer to a line extending along the tube at the center of the diameter of the tube. At a stage of the rotation, the second valve 304B may emerge from the predetermined maximum inner diameter of the hollow tube of sealing fluid and be configured to allow working fluid to leave the chamber through a different valve, and at a different pressure, to which it entered.

Figure 4A:
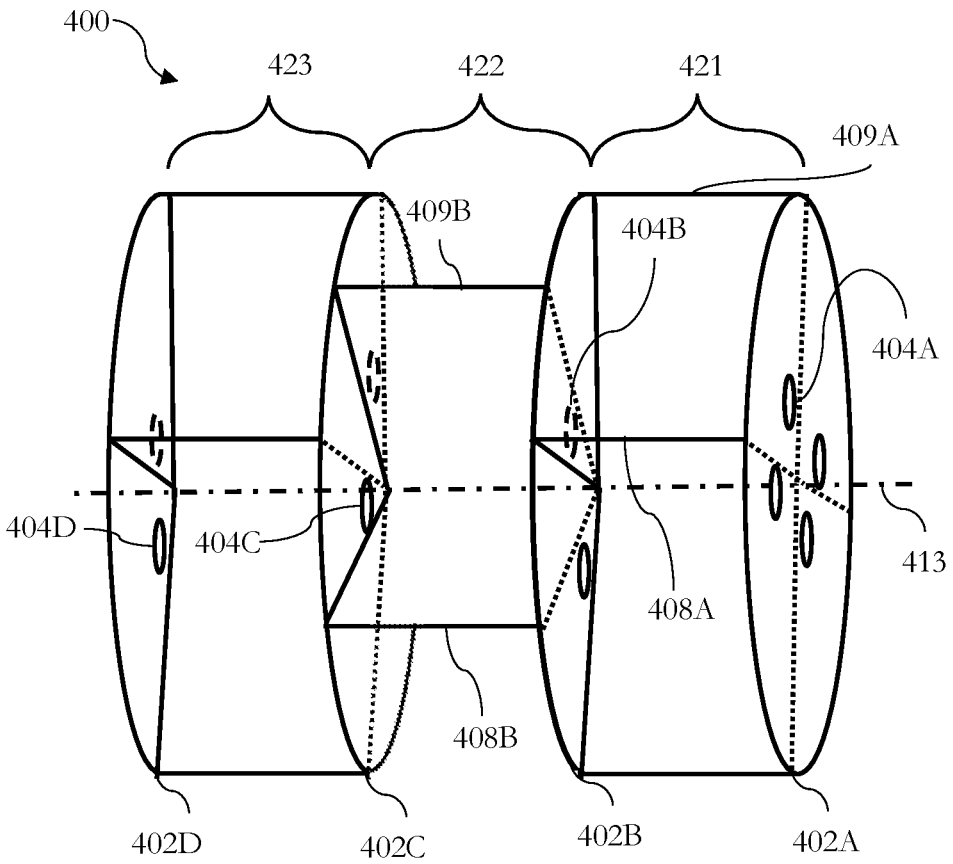
FIG. 4A shows a three-dimensional schematic representation of multiple plates of the valve arrangement with associated vane sets.

FIG. 4A shows a three-dimensional schematic representation of multiple plates 402A-D of the valve arrangement 400 with associated vane sets. Dashed lines show edges that may not be visible if, for example, the vanes or plates are opaque. Some vanes are not shown between the plates to aid intelligibility. Features described in relation to FIGS. 1, 2 and/or 3 may also apply to the corresponding features shown in FIG. 4A.

The first plate 402A may be joined to the second plate 402B, the third plate 402C and the fourth plate 402D. Each plate 402A-D may retain an orientation that is fixed relative to each other plate in the plurality of plates 402A-D. The first plate 402A and the second plate 402B may form a pair of plates. The second plate 402B and the third plate 402C may form a pair of plates. The third plate 402C and the fourth plate 402D may form a pair of plates. Each pair of plates may be spaced apart by a distance, wherein the distance between each pair of plates may increase, decrease or stay the same for each successive pair of plates. Each pair of plates may have an associated vane set disposed therebetween. The associated vane set being a vane set as described herein, for example, in relation to FIGS. 1, 2 and/or 3. Each pair of plates and the associated vane set therebetween may form a stage 421, 422, 423 or, more specifically, a first stage 421, a second stage 422 and a third stage 423. The first stage may be configured to be closest to a working fluid inlet and each progressive stage may be arranged to get progressively closer to a working fluid outlet. A first vane set may be disposed between the first plate 402A and the second plate 402B, a second vane set may be disposed between the second plate 402B and the third plate 402C, and a third vane set may be disposed between the third plate 402C and the fourth plate 402D.

Each vane set of the valve arrangement 400 may be arranged to match the orientation of every other vane set. An edge of each vane of a first vane set may overlap an edge of each vane of a second vane set. Alternatively, each vane set of the valve arrangement 400 may be offset, by a vane offset, from an adjacent vane set, such as a vane set of a preceding stage. Each vane set may be offset from the adjacent vane sets to provide a path for the working fluid that is helical relative to the valve arrangement. This helical path maximizes the path length of the working fluid through the system and, in this way, increases the change in volume of the working fluid provided by a valve arrangement of a given size.

A first chamber may be formed between two adjacent vanes 408A, 409A, the first plate 402A and the second plate 402B. A second chamber may be formed between two adjacent vanes 408B, 409B, the second plate 402B and the third plate 402C. aforementioned first and second chambers are successive chambers, because a valve 404B associated with the first chamber is also associated with the second chamber. For example, the first chamber may exchange a working fluid with the second chamber in use. Each successive chamber may act, in use, to further change the pressure of a working fluid. That is, if the first chamber is configured to increase the pressure of the working fluid, the second chamber will further increase the pressure of the working fluid output from the first chamber. Alternatively, if the first chamber is configured to decrease the pressure of the working fluid, the second chamber will further decrease the pressure of the working fluid output from the first chamber.

The valves of each successive plate of the valve arrangement 400 may not overlap. Valves that overlap are, for example, valves which are arranged to enter and/or exit the sealing fluid (or a predetermined maximum inner diameter of a hollow tube representing sealing fluid) at the same time. For example, the valve 404A of the first plate 402A may not overlap the valve 404B of the second plate 402B and valve 404B of the second plate 402B may not overlap with the valve 404C of the third plate 402C. However, valves of non-successive plates may overlap, for example the valves 404A, 404C of the first and third plates 402A, 402C may overlap. In some examples, the valve position may alternate between plates. For example, the valve(s) 404A of the first plate 402A may overlap the valve(s) 404C of the third plate 402C and valve(s) 404B of the second plate 402B may overlap the valve(s) 404D of the fourth plate 402D.

The valve arrangement 400 may be rotated at a first speed about the axis 413 as described in relation to FIG. 3. Furthermore, at a stage of the rotation, the second valve 404B may emerge from the predetermined maximum inner diameter of the hollow tube of sealing fluid and be configured to allow working fluid to leave the first chamber enter the second chamber through said second valve 404B, wherein the first chamber and second chamber are successive chambers. Successive chambers may be configured to operate at alternate compression stages. For example, the valve arrangement may have three successive chambers, the first chamber, the second chamber and a third chamber. The first chamber may fill with a working fluid at the same stage in the rotation of the valve arrangement 400 as the third chamber.

The valve arrangement may be configured to ensure that, in use, the sealing fluid does not migrate along the valve arrangement with the working fluid. The valve arrangement may be configured to ensure that, in use, there is insignificant force, or no overall force, exerted by said valve arrangement on the sealing fluid in a direction perpendicular to the plates of the valve arrangement.

As described above, an effective chamber may encompass different sub-chambers depending on the rotational stage of the valve arrangement. For example, the effective chamber may encompass a chamber of stages 421 and 422 in one rotational stage and encompass a chamber of stages 422 and 423 in a second rotational stage. Rotational stages of the valve arrangement refer to rotational positions of the valve arrangement when it is rotated about the axis 413, about which the valve arrangement is configured to be rotated.

Figure 4B:
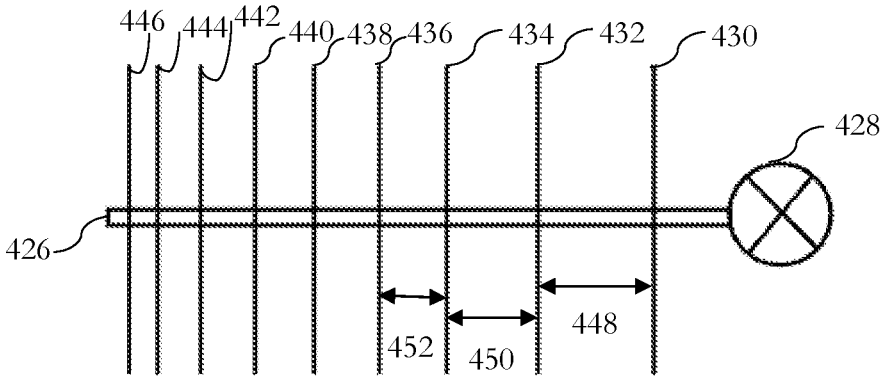
FIG. 4B shows a two-dimensional schematic representation of a side view of multiple plates of the valve arrangement with vane sets omitted to aid intelligibility.

FIG. 4B shows a two-dimensional schematic representation of a side view of multiple plates 430-446 of the valve arrangement with the vane sets omitted to aid intelligibility. In this example, a rotational device 428, such as a motor, is configured to impart a rotational force to the rod 426. The plates 430-446 are directly attached to the rod. In this way, the plates may be configured to rotate at the same speed as the rod 426. In some examples, the spacing 448, 450, 452 between the plates may be equal, such that the distances denoted by 448, 450 and 452 are the same. In this example, the second distance 450 between the second 432 and third 434 plates is smaller than the first distance 448 between the first 430 and second 432 plates. In some examples, the second distance 450 between the second 432 and third 434 plates may be larger than the first distance 448 between the first 430 and second 432 plates.

FIGS. 5A, 5B 5C, 5D, 5E and 5F are schematic representations of operational steps of a liquid ring system. The operational steps are ordered, by way of example only, to form a liquid ring compressor. In some examples, the steps may be performed in the order listed, that is 5A, 5B, 5C, 5D, 5E, then 5F. FIGS. 5A-F show an end view of a tubular vessel 502 containing sealing fluid 504. It may be understood that the tubular vessel is enclosed at each end, but this enclosure at each end is not shown. The predetermined maximum inner diameter of a hollow tube of sealing fluid may be the diameter of the circle 505. The circle 505 may extend throughout the tubular vessel 502. The area 528 within the circle 505 may be devoid of sealing fluid. The sealing fluid 504 may form a hollow tubular shape, such as the hollow cylindrical shape show in in FIGS. 5A-F, based on a centrifugal force imparted to the sealing fluid 504 by the rotation of the tubular vessel 502 and/or the agitation from the vanes 512, 516 of the valve arrangement 524.

The valve arrangement 524 may be, or be configured to be, rotated in a first direction 535 at a first speed. For example, the valve arrangement 524 may be rotated about a common point 514. The tubular vessel 502 may be, or be configured to be, rotated in a second direction 534 at a second speed. For example, the tubular vessel 502 may be rotated about a common and/or central point 506, shown only FIG. 5A to aid intelligibility. The common and/or central points 506, 514 of the tubular vessel 502 and valve arrangement 524 may be spaced apart by an offset 532.

The valve arrangement 524 may be, for example, a valve arrangement as described in any one of FIG. 2, 3, or 4. The valves 510, 519, 520, 526 shown with a solid line are disposed on a first plate. The valves 508, 518, 522, 530 shown with a dashed line in FIG. 5F are disposed on a second plate, wherein in the second plate is disposed behind the first plate with a vane set therebetween. The vane set shown in FIGS. 5A-F has four vanes and four chambers are formed therebetween. Each chamber is shown with two associated valves in FIG. 5F, but each chamber may have, or be associated with, more than two valves or at least two valves.

Figure 5A:
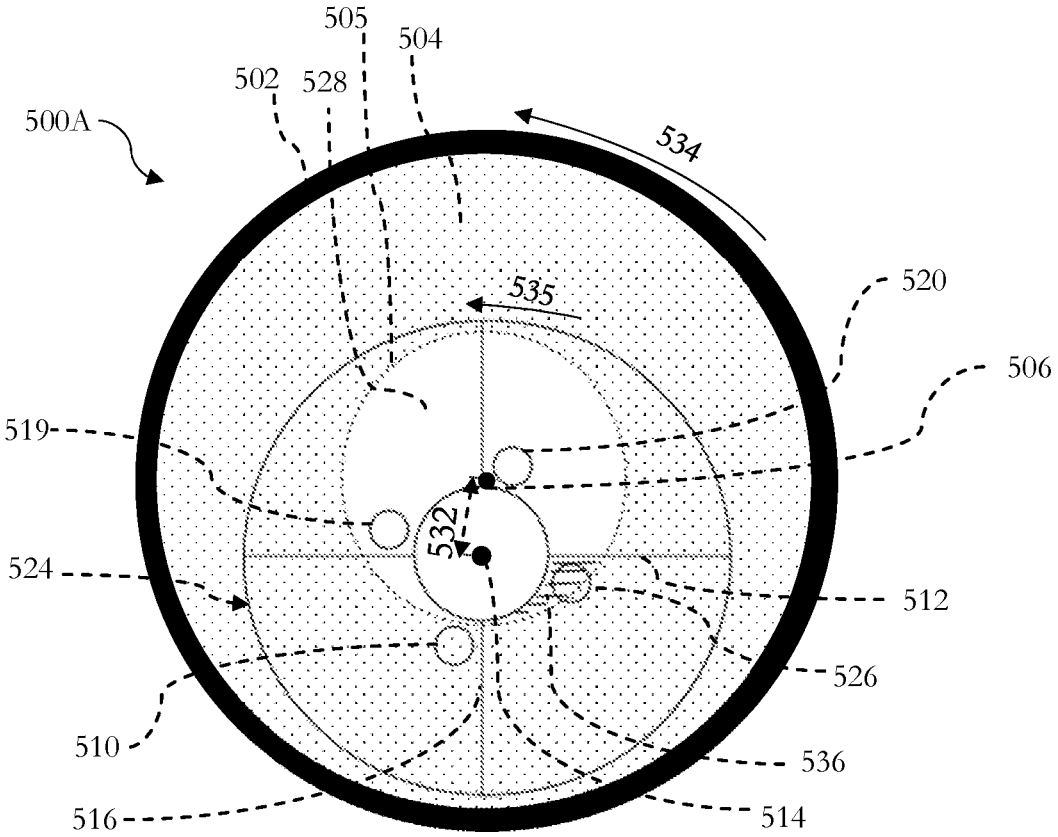
FIGS. 5A, 5B 5C, 5D, 5E and 5F are schematic representations of operational steps of a liquid ring system.

FIG. 5A shows first rotational stage 500A of the valve arrangement 524. The area 528 in front of the first plate contains a working fluid at a first pressure, which is allowed to enter the first chamber at the first pressure through the first valve 526. The working fluid being provided to the tubular vessel 502 from a working fluid inlet valve (not shown) disposed on the tubular vessel 502. The working fluid flows in through the first valve 526 to fill the associated chamber with working fluid 536 (horizontal lines) at the first pressure.

Figure 5B:
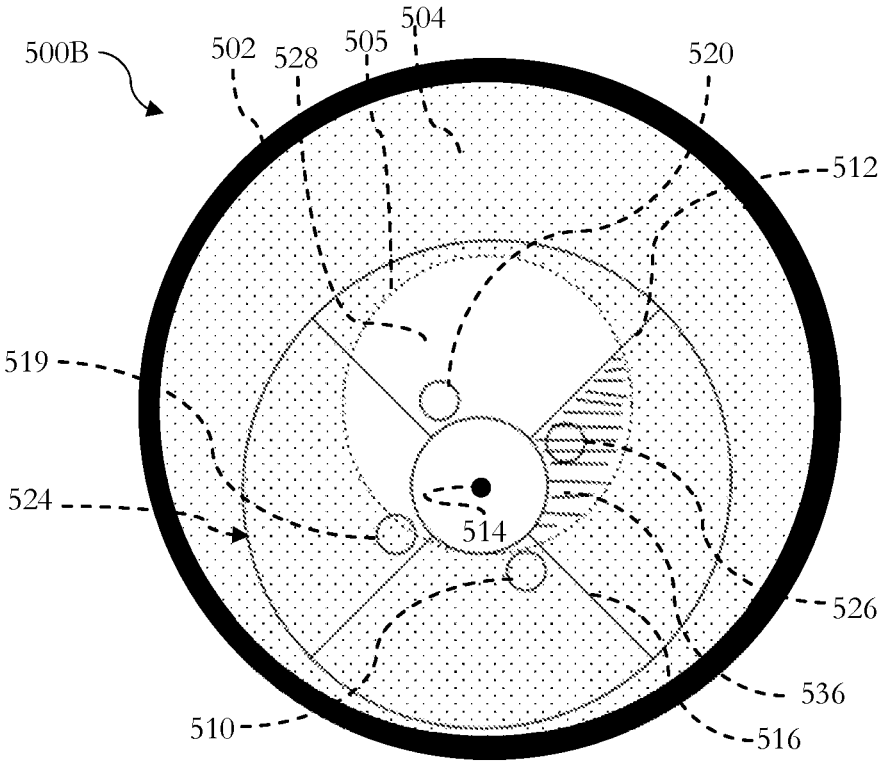

FIG. 5B shows a second rotational stage 500B of the valve arrangement 524. This rotational stage may follow the first rotational stage when rotating the valve arrangement 524 in the first direction 535. In this stage, the volume of the chamber associated with valve 526 has increased because there is less sealing fluid present within this chamber. As the valve 526 remains exposed to the working fluid at the first pressure, the chamber will fill to include an increased volume of working fluid 536 at the first pressure.

Figure 5C:
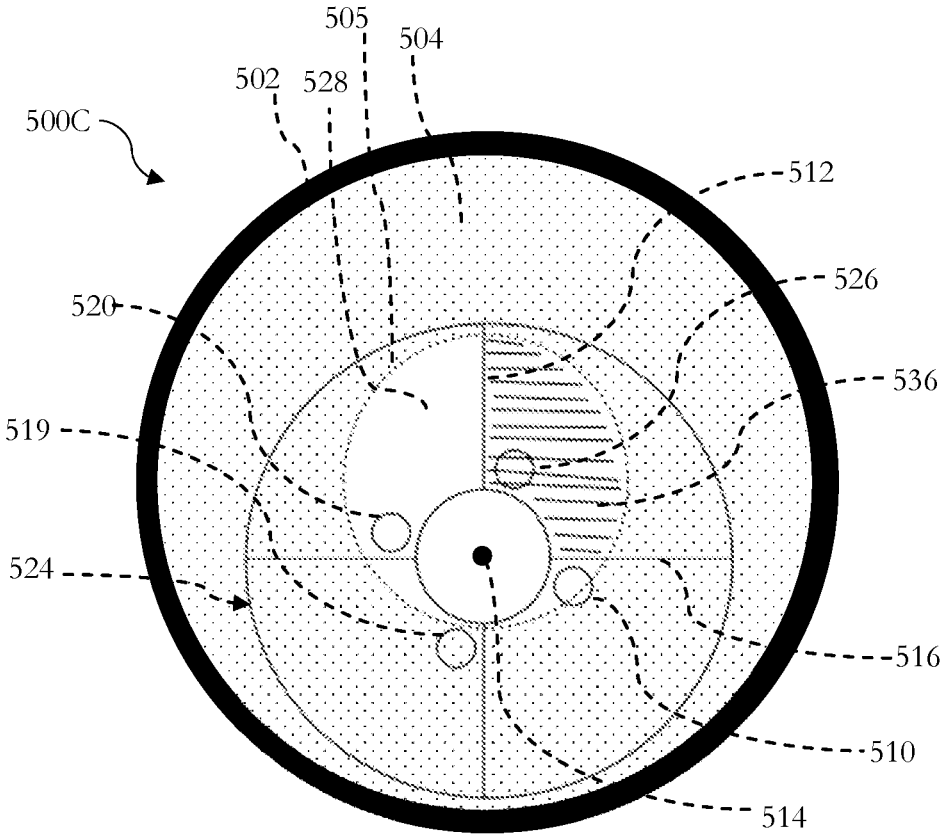

FIG. 5C shows a third rotational stage 500C of the valve arrangement 524. This rotational stage may follow at least one of the first and second rotational stages when rotating the valve arrangement 524 in the first direction 535. In this stage, the volume of the chamber associated with valve 526 has increased further because there is less sealing fluid present within this chamber. As the valve 526 remains exposed to the working fluid at the first pressure, the chamber will fill to include an increased volume of working fluid 536 at the first pressure.

Figure 5D:
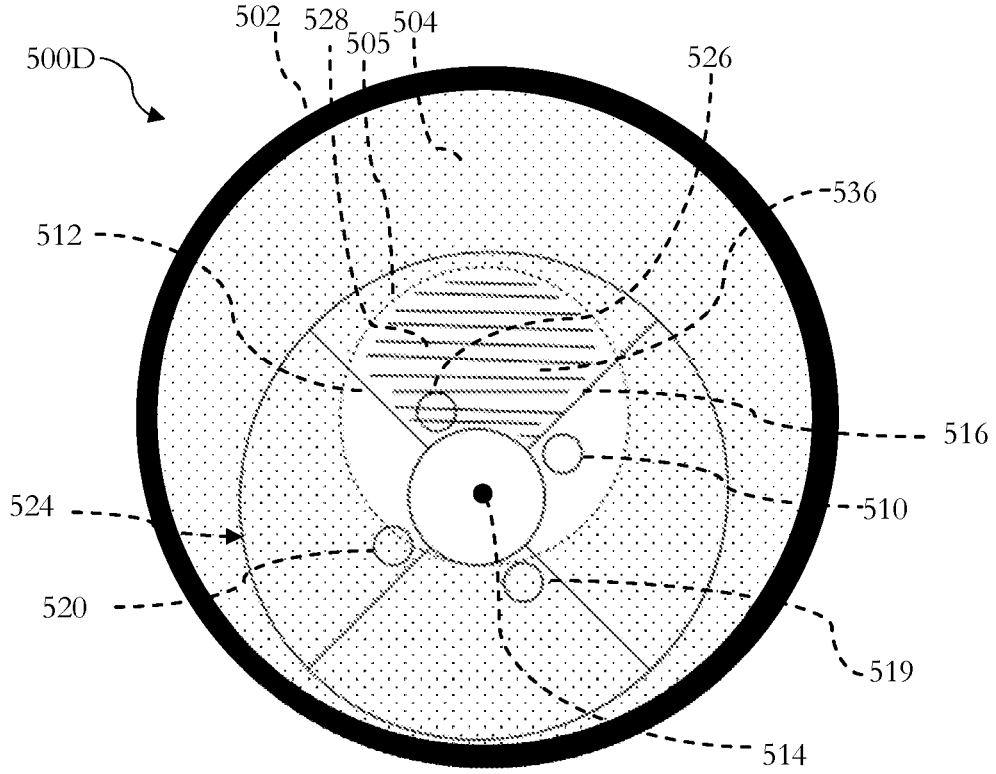

FIG. 5D shows a fourth rotational stage 500D of the valve arrangement 524. This rotational stage may follow at least one of the first, second or third rotational stages when rotating the valve arrangement 524 in the first direction 535. In this stage, the volume of the chamber associated with valve 526 has increased to its maximum point because the chamber is at the stage of rotation in which it contains the least sealing fluid 504. As the valve 526 remains exposed to the working fluid at the first pressure, the chamber will fill to include an increased volume of working fluid 536 at the first pressure.

Figure 5E:
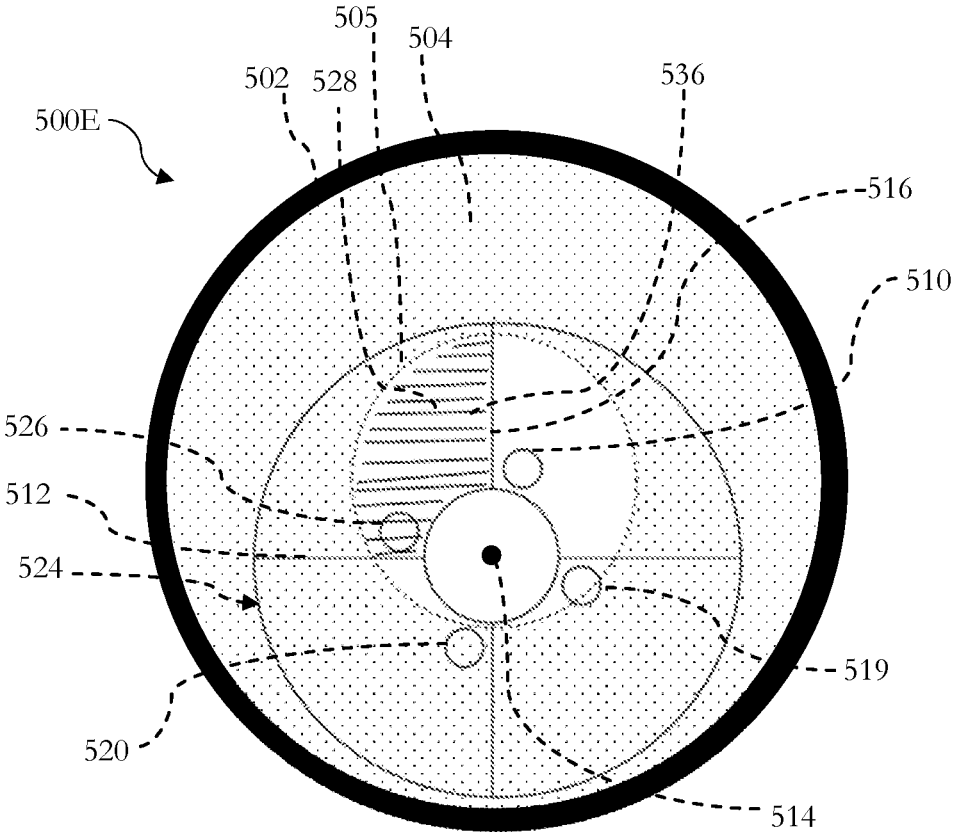
Figure 5F:
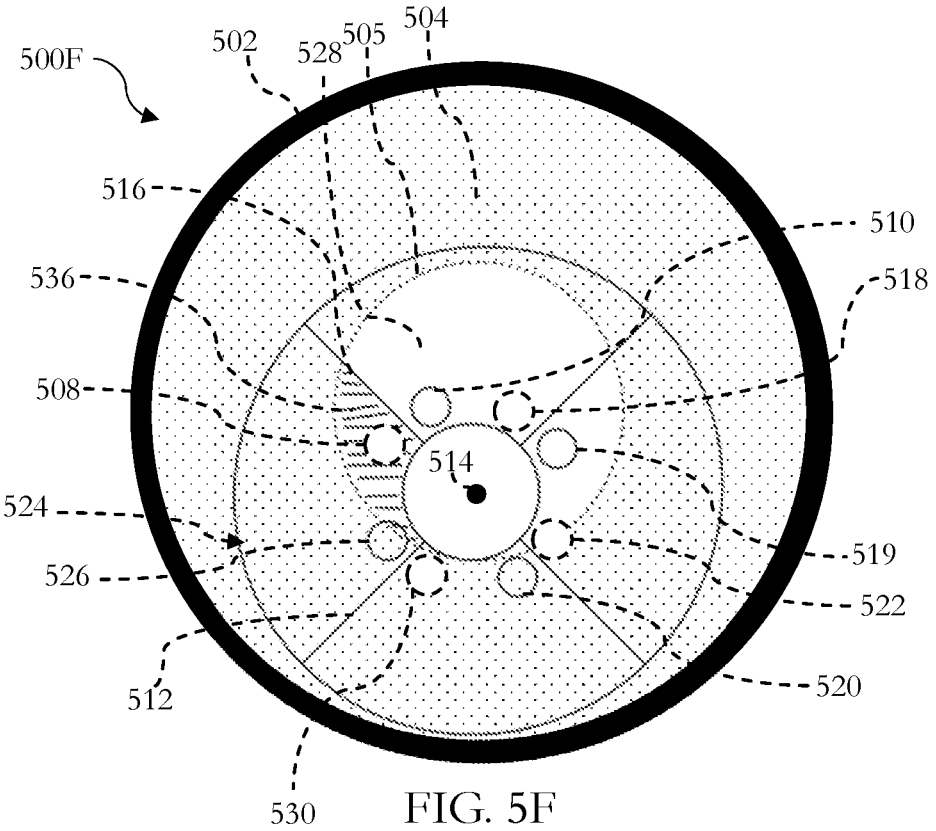

FIG. 5E shows a fifth rotational stage 500E of the valve arrangement 524. This rotational stage may follow at least one of the first, second, third or fourth rotational stages when rotating the valve arrangement 524 in the first direction 535. As the rotation of the valve arrangement 524 continues in the first direction 535 the volume of the chamber associated with valve 526 decreases due to an increase in sealing fluid 504 between the vanes 512, 516 associated with the valve 526. The decreased volume of the chamber associated with valve 526 results in a reduced volume of the working fluid. The mass of the working fluid is unchanged because backflow through the valve arrangement 524 is prevented. As the volume of the chamber, and therefore the working fluid contained within the chamber decreases, but the mass of the working fluid is unchanged, the pressure of the working fluid 536 within the chamber is increased.

FIG. 5F shows the sixth rotational stage 500F of the valve arrangement 524. This rotational stage may follow at least one of the first, second, third, fourth or fifth rotational stages when rotating the valve arrangement 524 in the first direction 535. As the rotation of the valve arrangement 524 continues in the first direction 535 the volume of the chamber associated with valve 526 decreases due to an increase in sealing fluid 504 between the vanes 512, 516 associated with the valve 526. The decreased volume of the chamber associated with valve 526 results in a reduced volume of the working fluid. The mass of the working fluid is unchanged because backflow through the valve arrangement 524 is prevented. As the volume of the chamber, and therefore the working fluid contained within the chamber decreases, but the mass of the working fluid is unchanged, the pressure of the working fluid 536 within the chamber is therefore increased.

Due to at least one of this increase in pressure and the rotational position of the valve arrangement, this compressed working fluid 536 is allowed to pass through the valve 508, either into the next stage of the liquid ring system or though the outlet of the tubular vessel. In some examples, the volume of working fluid within the chamber would decrease to less than half of its original volume. Decreasing the volume of the working fluid to half of its original volume would result in the pressure of the working fluid doubling. The rotation of the valve arrangement 524 may continue until the stage described in relation to FIG. 5A is again reached.

Backflow through the valve arrangement during compression may be prevented in a number of ways. In some examples, each valve of the at least one valve arrangement comprises a non-return valve and/or a pressure sensitive valve to prevent the working fluid from escaping back through valve 526. In other examples, the valve 526 may be arranged to be submerged in, or otherwise sealed by, the sealing fluid 504 to prevent the flow of working fluid therethrough as the working fluid is compressed. The valve 508 may include a pressure sensitive valve, to prevent working fluid from passing through the valve 508 before the working fluid 536 is compressed to a predefined minimum threshold pressure. In some examples, the valve 508 may be arranged to be submerged in the sealing fluid 504, or otherwise prevented from flowing into another volume and/or chamber by the sealing fluid 504.

In some examples, backflow from the chamber can be prevented without necessitating specific pressure sensitive or non-return valves. The valves 526 and 508 of the valve arrangement 524 may be arranged such that: in a first stage of the rotation, valve 526 is unobstructed by sealing fluid 504 to enable working fluid to enter therethrough whilst valve 508 is arranged to be submerged in, or otherwise sealed by, the sealing fluid 504 to prevent the flow of working fluid therethrough, this is maintained as the chamber fills with additional working fluid in stage two; in a third rotational stage, once the chamber is filled with a predetermined volume of working fluid 536, the valves 526 and 508 are both submerged in, or otherwise sealed by, the sealing fluid 504 to prevent the flow of working fluid therethrough, this is maintained in the fourth and fifth rotational stages as the chamber reduces in size and the working fluid is compressed; in a sixth rotational stage, valve 526 is submerged in, or otherwise sealed by, sealing fluid 504 to prevent backflow of the compressed working fluid whilst valve 508 is unobstructed by sealing fluid 504 to enable compressed working fluid to exit therethrough.

In some examples, backflow through the valve arrangement 524 can be prevented without necessitating specific pressure sensitive or non-return valves, or constraining the compression of a single chamber with specific requirements to prevent backflow. This may enable liquid ring system designs to be provided that are low cost and simple to manufacture, with greater efficiency due to less restrictive design requirements.

Backflow from a specific chamber can be prevented without necessitating specific pressure sensitive or non-return valves, as described above. A similar approach to prevent backflow can be provided with a group of multiple successive chambers, rather than a single chamber, to prevent backflow. For example, two, three or five successive chambers from two, three or five successive stages of the valve arrangement 524 may be used to prevent backflow in a valve arrangement with four, six or ten stages, respectively. In this way, an angular offset required between the first and second valves to ensure the first and last valve can be simultaneously submerged in the sealing fluid to prevent backflow can be shared between the group of successive chambers, rather than one large angular offset in a single chamber. Angular offset herein defines an angle between the respective centers of two rotationally spaced features, wherein the angle is measured at the point about which the features rotate.

This group of successive chambers may include valves arranged such that working fluid is permitted to enter all of the chambers in the successive group of chambers at once, with the a valve associated with the last chamber in the successive group of chambers being submerged in, or otherwise sealed by the sealing fluid. Once the successive group of chambers is filled with working fluid, a valve associated with the first chamber of the group of chambers is submerged in, or otherwise sealed, by the sealing fluid 504. The working fluid is then compressed within the successive group of chambers, with the first chamber in the successive group of chambers having reduced in volume by the greatest proportion. The valve associated with the last chamber in the successive group of chambers reaches a stage of the rotation in which it becomes unobstructed as the valve associated with the first chamber in the successive group of chambers becomes submerged in or otherwise sealed by the sealing fluid. This allows the working fluid to move along the valve arrangement, in a successive group of chambers, stage by stage and/or chamber by chamber.

For example, in a six stage valve arrangement, the successive group of chambers may be three chambers, with working fluid starting in chambers 1, 2 and 3, from stages 1, 2 and 3. Then, after a full rotational cycle has been completed, the working fluid is pushed out from chamber 1 from stage 1 and is instead contained within chambers 2, 3 and 4, from stages 2, 3 and 4. Then, after another rotational cycle is completed, the working fluid is contained within chambers 3, 4 and 5 of stages 3, 4 and 5. In this way, the working fluid in the successive group of chambers takes a helical path about the valve arrangement, relative to the valve arrangement.

It may be understood that the rotational stages described in FIGS. 5A-F may occur in each chamber of the valve arrangement sequentially as each respective valve emerges from the sealing fluid 504. Similarly, the rotational stages could be reversed, or operated in the reverse direction, to provide a liquid ring expander, rather than the liquid ring compressor described in FIGS. 5A-F by way of example. The representations shown are by way of example only, and it may be understood that the relative sizes may be significantly different from those shown, for example, the plates may be considerably larger than the valves. That is, the diameter of each plate of the plurality of plates may be at least 10, 100 or 1000 times the diameter of each valve of the respective plate.

Figure 6A:
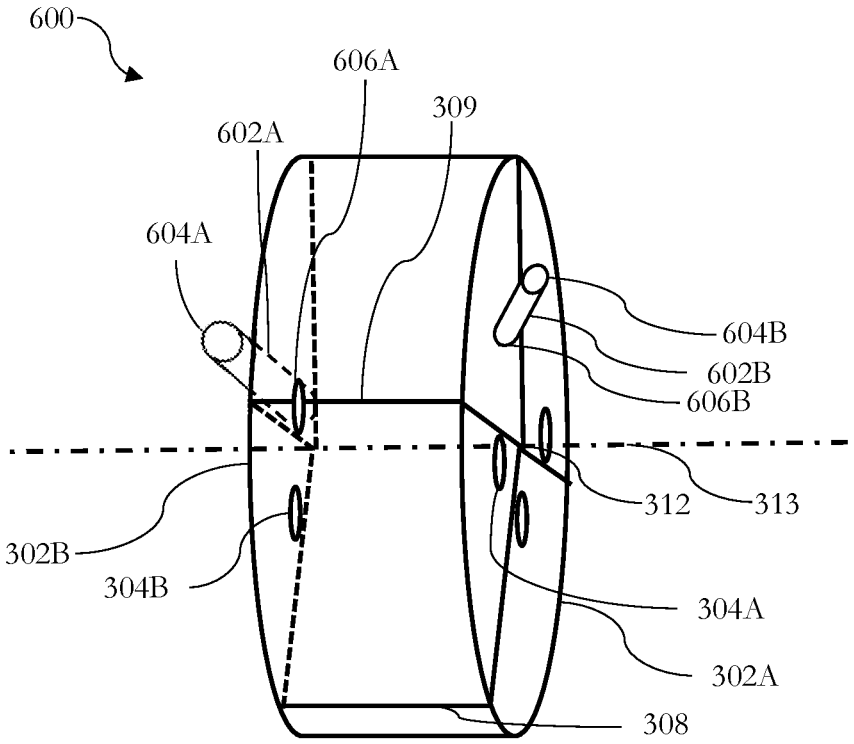
FIG. 6A shows a three-dimensional schematic representation of two plates of the valve arrangement with an associated vane set and tubular members attached to a subset of the valves.

The valve arrangement described herein may be modified in various ways to alter characteristics of the compression or decompression cycles. FIG. 6A shows a three-dimensional schematic representation 600 of two plates of the valve arrangement and an associated vane set, as described in relation to FIG. 3. However, the representation 600 further comprises two tubular members 602A, 602B. These tubular members may be implemented on any of the plates described or shown herein to alter the characteristics of the compression or decompression cycles. These tubular members 602A, 602B may be open-ended tubular member members 602A, 602B. Each tubular member having a first end 606A, 606B fluidically connected to a chamber and/or a valve of the chamber. The tubular members have a second end 604A, 604B. The second end of the tubular member may be rotationally offset from the respective valve of the chamber. In some examples, the second end is configured to submerge and emerge from the sealing fluid, and/or a predetermined maximum inner diameter of a hollow tube of sealing fluid, at a different point in the rotation of the valve arrangement to the respective valve of the respective chamber. The tubular members may be attached to a subset of the valves of a plate, a subset of valves of the valve arrangement, all of the valves of a plate, or all of the valves of the valve arrangement. For example, the tubular members may be attached to a subset, or all, of the valves of the first, second, third, fourth and/or last plate of the valve arrangement.

In this way, the compression or decompression ratio can be configured and optimized for a given application. Furthermore, dimensional flexibility and versatility of the valve arrangement is increased. FIG. 6A shows tubular members connected to only one chamber, but the tubular members may be attached to one or more chambers of the valve arrangement.

Figure 6B:
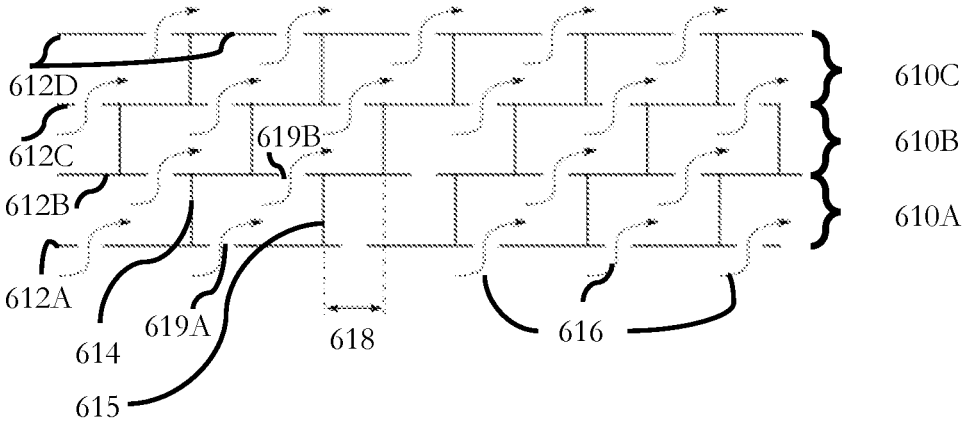
FIG. 6B shows a schematic representation of a chamber net of the valve arrangement described herein.

FIG. 6B shows a schematic representation of a chamber net of the valve arrangement. A chamber net as described herein refers to a schematic view of a three-dimensional chamber layout of a valve arrangement represented in two-dimensional space to show the flow of working fluid through the valve arrangement.

The chamber net shown in FIG. 6B shows a perimeter of a first 612A, second 612B, third 612C and fourth 612D plate of the valve arrangement and the outer most edge of the vanes 614, 615. The plates and vanes of FIG. 6B combine to form the first 610A, second 610B and third 610C stages of the valve arrangement. The valves 619A, 619B are shown by breaks in the plate and the flow 616 of working fluid is shown by dashed arrows.

A maximum angular offset 618 possible between the chambers in each successive stage in FIG. 6B (i.e. without the tubular members 602A, 602B) may be less than an angular offset between the first 614 and second 615 vanes of a given chamber. More specifically, the maximum angular offset 618 possible between the chambers in each successive stage in FIG. 6B may be the angular offset between the first 614 and second 615 vanes of a given chamber, minus the sum of the maximum angular offset between any two points of the first valve 619A and maximum angular offset between any two points of the second valve 619B.

Figure 6C:
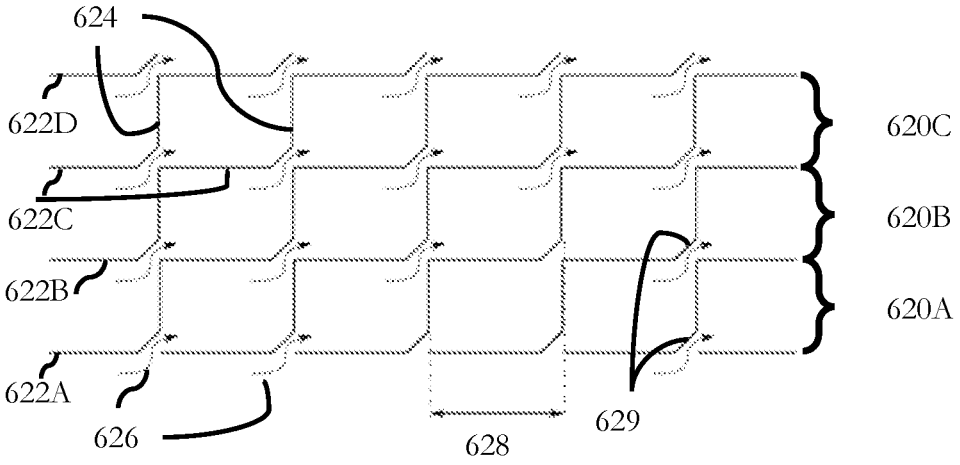
FIGS. 6C and 6D show schematic representations of a chamber net of the valve arrangement described herein with additional tubular members
Figure 6D:
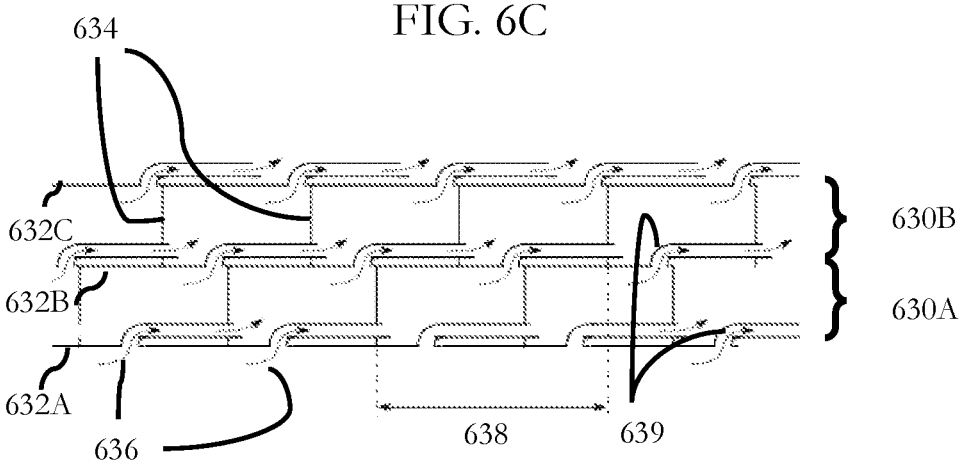

FIGS. 6C and 6D show schematic representations of a chamber net of the valve arrangement with tubular members of different configurations.

The chamber net shown in FIG. 6C shows a perimeter of a first 622A, second 622B, third 622C and fourth 622D plate of the valve arrangement and the outer most edge of the vanes 624. The plates and vanes of FIG. 6C combine to form the first 620A, second 620B and third 620C stages of the valve arrangement. The valves are fluidically connected to tubular members 629. The flow 626 of working fluid through these tubular members 629 is shown by dashed arrows.

A maximum angular offset 628 possible between the chambers in each successive stage in FIG. 6C is increased by the tubular members 629. The maximum angular offset 628 may be the angular offset between the vanes 624 of a given chamber as shown in FIG. 6C.

The chamber net shown in FIG. 6D shows a perimeter of a first 632A, second 632B, and third 632C plate of the valve arrangement and the outer most edge of the vanes 634. The plates and vanes of FIG. 6D combine to form the first 630A, and second 630B stages of the valve arrangement. The valves are fluidically connected to tubular members 639. The flow 636 of working fluid through these tubular members 639 is shown by dashed arrows.

A maximum angular offset 638 possible between the chambers in each successive stage in FIG. 6D is increased by the tubular members 639. The maximum angular offset 638 may be greater than the angular offset between the vanes 624 of a given chamber as shown in FIG. 6D.

Figure 7:
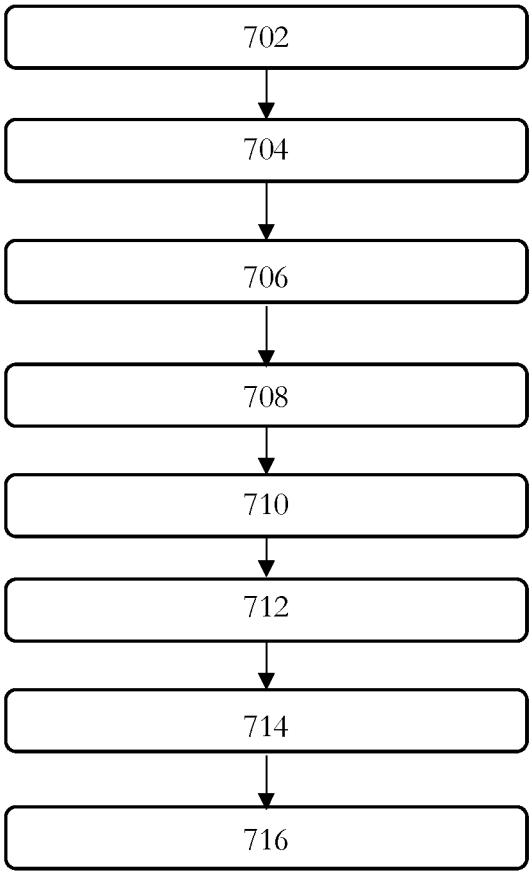
FIG. 7 shows a flowchart in accordance with a method for operating a liquid ring system.

FIG. 7 shows a flowchart in accordance with a method for operating a liquid ring system. The method comprises rotating 702 the tubular vessel of the liquid ring system about the second axis at a second speed and applying 704 working fluid, from a source of working fluid, at a first pressure to the working fluid inlet. The method also comprises rotating 706 the valve arrangement about the first axis at the first speed to cause a change in pressure within the first chamber by submerging 708 the second valve into the sealing fluid, emerging 710 the first valve from the sealing fluid, submerging 712 the first valve into the sealing fluid, adjusting 714 a penetration depth of a first chamber into the sealing fluid, and emerging 716 the second valve from the sealing fluid.

Figure 8:
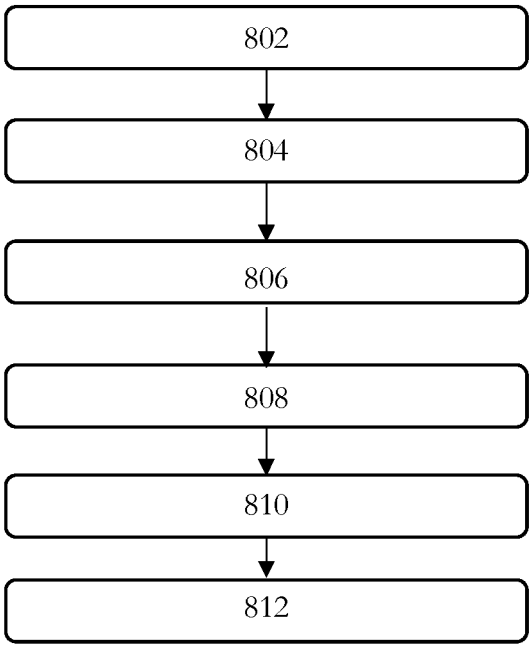
FIG. 8 shows a flowchart in accordance with a method for operating a valve arrangement in a liquid ring system.

FIG. 8 shows a flowchart in accordance with a method for operating a valve arrangement in a liquid ring system. The method comprising rotating 802 the valve arrangement described herein about the first axis at the first speed to cause a change in pressure within the first chamber by: submerging 804 the second valve through a predetermined maximum inner diameter of a hollow tube of sealing fluid, emerging 806 the first valve from the predetermined maximum inner diameter of the hollow tube of sealing fluid, submerging 808 the first valve through the predetermined maximum inner diameter of the hollow tube of sealing fluid, adjusting 810 a penetration depth of the first chamber into the predetermined maximum inner diameter of the hollow tube of sealing fluid, and emerging 812 the second valve from the predetermined maximum inner diameter of the hollow tube of sealing fluid.

The invention claimed is:

1. A valve arrangement for a liquid ring system comprising:

a plurality of plates arranged to face each other, comprising a first plate and a second plate spaced apart by a first distance, and each plate of the plurality of plates comprising at least one valve, wherein each of the plurality of plates is configured to be rotatable about a first axis at a first speed;

a vane set disposed between the first plate and the second plate, each vane of the vane set having a first face and a second face;

a chamber set comprising at least one chamber, wherein a first chamber of the chamber set is bounded by the first plate, the second plate, the first face of a first vane of the vane set, and the second face of a second vane of the vane set, wherein each vane of the vane set is impermeable to a working fluid and each vane extends between the first plate and the second plate to prevent the working fluid from bypassing the vane, in use, when the working fluid is disposed between the first plate and the second plate; and wherein the first chamber of the chamber set comprises:

a first valve of the at least one valve, disposed on the first plate, wherein at least a portion of the first valve of the at least one valve is configured to be closer to the first face of the first vane of the vane set than the second face of the second vane of the vane set; and a second valve of the at least one valve, disposed on a second plate, wherein at least a portion of the second valve of the at least one valve is configured to be closer to the second face of the second vane than the first face of the first vane.

2. The valve arrangement of claim 1, wherein the plurality of plates comprise a third plate that faces an opposite side of the second plate to the first plate, the third plate being spaced apart from the second plate by a second distance, wherein a third valve of the at least one valve is disposed on the third plate and a second vane set disposed between the second plate and third plate, each vane of the second vane set having a first face and a second face, and/or wherein the first, second and third valves of the at least one valve are rotationally spaced about the first axis such that the second valve of the at least one valve does not overlap the first valve of the at least one valve or the third valve of the at least one valve.

3. The valve arrangement of claim 2, wherein the second distance not equal to the first distance.

4. The valve arrangement of claim 2, wherein the plurality of plates includes a first number of plates and the chamber set includes a second number of chambers, the first number of plates being at least one more than the second number of chambers.

5. The valve arrangement of claim 1, wherein the first chamber is further configured to be bounded, in use, by a sealing fluid at a perimeter of the first plate and a perimeter of the second plate, and/or wherein the at least one valve is arranged on each plate of the plurality of plates such that, in use, it is submerged through a predetermined maximum inner diameter of a hollow tube of sealing fluid during the rotation of the plurality of plates, said arrangement being based on said predetermined maximum inner diameter and a predetermined offset between a center of said predetermined maximum inner diameter and the first axis.

6. The valve arrangement of claim 1, wherein the first vane of the vane set, and the second vane of the vane set are the same vane.

7. The valve arrangement of claim 1, wherein each valve of the at least one valve comprises an opening in the plate and/or an open-ended tubular member.

8. The valve arrangement of claim 1, wherein each valve of the at least one valve comprises a non-return valve and/or a pressure sensitive valve.

9. A liquid ring system that comprises:

the valve arrangement of claim 1 disposed within a tubular vessel;

the tubular vessel comprising a working fluid inlet at a first end of the tubular vessel and a working fluid outlet at a second end of the tubular vessel, wherein the tubular vessel is configured to retain a sealing fluid and to be rotated at a second speed that exerts a centrifugal force on the sealing fluid and wherein the axis of rotation of the tubular vessel is a second axis that is offset from the first axis by a first offset; and wherein the liquid ring system is configured such that, in use, an edge of each plate of the plurality of plates is submerged in the sealing fluid such that a working fluid is only able to pass within the tubular vessel, between the working fluid inlet and working fluid outlet, through the at least one valve of each plate of the plurality of plates.

10. The liquid ring system of claim 9, wherein liquid ring system is a liquid ring pump, a liquid ring compressor, a liquid ring decompressor and/or a liquid ring expander.

11. The liquid ring system of claim 9, wherein within the tubular vessel the working fluid is less dense than the sealing fluid as measured by at least one known measurement technique.

12. The liquid ring system of claim 9, wherein the working fluid is a gas and the sealing fluid is a liquid.

13. The liquid ring system of claim 9, wherein the first speed is the same as the second speed.

14. The liquid ring system of claim 9, wherein a hollow tube of sealing fluid having a predetermined maximum inner diameter is formed in use by the rotation of the tubular vessel and at least one of the first valve of the at least one valve and second valve of the at least one valve is arranged to be submerged in the hollow tube of sealing fluid at any stage of rotation of the valve arrangement, based on said predetermined maximum inner diameter of the sealing fluid and the first offset, to prevent a reverse flow of working fluid through the vessel.

15. A method for operating a liquid ring system, comprising:

rotating the tubular vessel of the liquid ring system of claim 9 about the second axis at a second speed;

applying working fluid, from a source of working fluid, at a first pressure to the working fluid inlet;

rotating the valve arrangement about the first axis at the first speed to cause a change in pressure within the first chamber by:

submerging the second valve of the at least one valve into the sealing fluid;

emerging the first valve of the at least one valve from the sealing fluid to expose the first valve of the at least one valve to the working fluid, such that the working fluid fills the chamber at the first pressure;

enclosing the first chamber within the bounds of the first plate, the second plate, the first face of a first vane of the vane set, and the second face of a second vane of the vane set, by preventing reverse flow of working fluid through the first valve of the at least one valve using at least one of a backflow prevention valve, a preceding sealed chamber of the valve arrangement in pressure communication with the first chamber or by submerging the first valve of the at least one valve in the sealing fluid;

adjusting a penetration depth of the first chamber into the sealing fluid, based at least in part on the offset of the second axis from the first axis, to adjust a volume of the first chamber; and emerging the second valve of the at least one valve from the sealing fluid.

16. A method for operating a valve arrangement in a liquid ring system, comprising:

rotating the valve arrangement of claim 1 about the first axis at the first speed to cause a change in pressure within the first chamber by:

submerging the second valve of the at least one valve through a predetermined maximum inner diameter of a hollow tube of sealing fluid;

emerging the first valve of the at least one valve from the predetermined maximum inner diameter of the hollow tube of sealing fluid;

enclosing the first chamber within the bounds of the first plate, the second plate, the first face of a first vane of the vane set, and the second face of a second vane of the vane set, by preventing, in use, a reverse flow of working fluid through the first valve of the at least one valve using at least one of a backflow prevention valve, a preceding sealed chamber of the valve arrangement in pressure communication with the first chamber or by submerging the first valve of the at least one valve through the predetermined maximum inner diameter of the hollow tube of sealing fluid;

adjusting a penetration depth of the first chamber into the predetermined maximum inner diameter of the hollow tube of sealing fluid, based at least in part on a predetermined offset between a center of said predetermined maximum inner diameter and the first axis; and emerging the second valve of the at least one valve from the predetermined maximum inner diameter of the hollow tube of sealing fluid.

* * * * *